US009046827B2

(12) United States Patent
Nakagaki et al.

(10) Patent No.: US 9,046,827 B2
(45) Date of Patent: Jun. 2, 2015

(54) BELT DRIVING APPARATUS AND IMAGE FORMING APPARATUS

(71) Applicant: CANON KABUSHIKI KAISHA, Tokyo (JP)

(72) Inventors: Jun Nakagaki, Abiko (PA); Yuhei Takei, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/262,980

(22) Filed: Apr. 28, 2014

(65) Prior Publication Data

US 2014/0334856 A1 Nov. 13, 2014

(30) Foreign Application Priority Data

May 9, 2013 (JP) ..... 2013-099322

(51) Int. Cl.
*G03G 15/01* (2006.01)
*G03G 15/16* (2006.01)

(52) U.S. Cl.
CPC .. *G03G 15/1615* (2013.01); *G03G 2215/00143* (2013.01); *G03G 2215/00156* (2013.01); *G03G 2215/0132* (2013.01)

(58) Field of Classification Search
USPC ..... 399/227, 298, 302, 303
See application file for complete search history.

(56) References Cited

U.S. PATENT DOCUMENTS

2007/0127953 A1* 6/2007 Saeki et al. ..... 399/302
2012/0213560 A1 8/2012 Takei

FOREIGN PATENT DOCUMENTS

JP H11-030917 A 2/1999
JP 2001-355693 A 12/2001
JP 2012-108219 A 6/2012

* cited by examiner

*Primary Examiner* — Clayton E Laballe
*Assistant Examiner* — Minh Phan
(74) *Attorney, Agent, or Firm* — Fitzpatrick, Cella, Harper & Scinto

(57) ABSTRACT

A belt driving apparatus is configured so as to satisfy a relationship $\mu_1(2T\sin(\theta_1/2)+f_1)<\mu_2(2T\sin(\theta_2/2)+f_2)$, wherein $\mu_1$ is a dynamic friction coefficient between the supporting roller and the endless belt, $\mu_2$ is a dynamic friction coefficient between the steering roller and the endless belt, $\theta_1$ is a winding angle of the endless belt with respect to the supporting roller, $\theta_2$ is a winding angle of the endless belt with respect to the steering roller, $f_1$ is the first external force applied to the supporting roller through the endless belt, $f_2$ is the second external force applied to the steering roller through the endless, and T is a tension force applied to the endless belt by the tension roller.

13 Claims, 18 Drawing Sheets

FIG.10A Raised Position
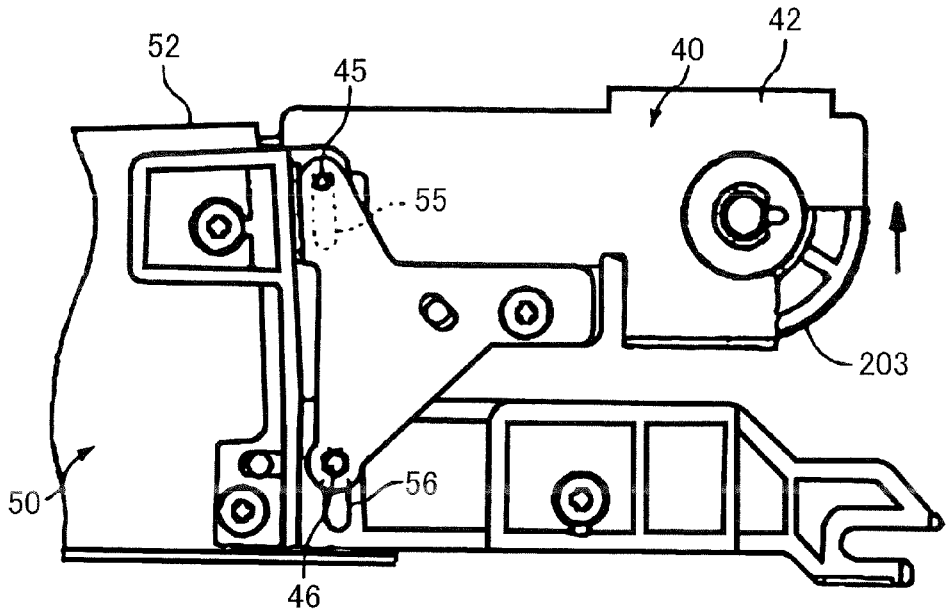
FIG.10B Lowered Position
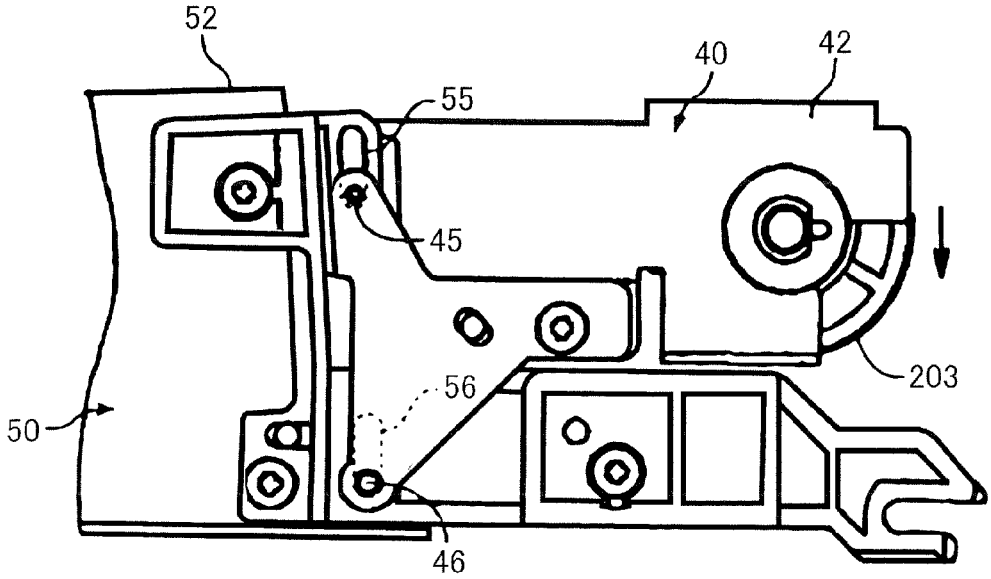

When R side of Steering Roller is moved upward

BELT DRIVING APPARATUS AND IMAGE FORMING APPARATUS

BACKGROUND OF THE INVENTION

1. Field of the Invention

The present invention relates to a belt driving apparatus that rotationally drives an endless belt, and an image forming apparatus that is provided with the belt driving apparatus, such as a copier, a facsimile, and a printer.

2. Description of the Related Art

As an image forming apparatus that uses an electrophotography method, an image forming apparatus employing a so-called intermediate transfer method has been known. This type of image forming apparatus creates a full-color toner image on an intermediate transfer belt (ITB) serving as an endless belt.

In addition, as an image forming apparatus intended for high speed operations, there is an image forming apparatus that detects a deviation of the endless belt and controls an alignment of a stretching roller, so that a position of the stretching roller along a longitudinal direction (an axial direction) is maintained within a substantial constant range.

JP-A-2001-355693 discloses a belt apparatus configured in such a manner that a friction force between the endless belt and a driven roller, which serves as the stretching roller, is smaller than a friction force between the endless belt and a driving roller, which serves as the stretching roller. As a result, deformation such as waving and wrinkling can be prevented.

In such a belt apparatus, a so-called "belt deviation" may occur. In other words, the intermediate belt is deviated toward either one of both end portions of the stretching roller at the time of being driven. This may be caused by, for example, variations in accuracy of an outer diameter of the stretching roller, variations in accuracy of mutual alignments between rollers, and the like. In the belt driving apparatus employing a belt deviation control scheme to prevent the belt deviation, the belt deviation control becomes inoperative when the intermediate transfer belt slips on a steering roller. In order to avoid this, a friction coefficient between the steering roller and the intermediate transfer belt is preferably set greater.

Therefore, when the configurations disclosed in JP-A-2001-355693 are applied to the belt driving apparatus of the belt deviation control scheme, the driving roller, rather than the driven roller, should preferably function as the steering roller.

As an image forming apparatus of a vertical path scheme, which is beneficial to make the apparatus compact, there is a type of image forming apparatus configured in such a manner that a pressure can be applied to an outer secondary transfer roller and thus on an inner secondary transfer roller positioned on the other side of the steering roller through the intermediate transfer belt. In such an image forming apparatus, a cleaning blade may be provided so as to be in contact with the intermediate transfer belt supported by the steering roller, thereby to retrieve residual toners remaining on the intermediate transfer belt. When such a cleaning blade is used, a pressure applied to the outer secondary transfer roller and thus on the inner secondary transfer roller becomes greater than a pressure applied to the steering roller from the cleaning blade.

Here, a force caused between the stretching roller and the intermediate transfer belt is obtained by multiplying the friction coefficient between the stretching roller and the intermediate transfer belt with the normal force.

The normal force corresponds to a component force of a tensional force applied to the intermediate transfer belt and a force applied from outside, along a radius direction of the stretching roller.

Therefore, in a case where the configurations of JP-A-2001-355693 are applied to the apparatus employing the belt deviation control scheme, even when a friction coefficient of the driven roller with respect to the intermediate transfer belt may be smaller than a friction coefficient of the driving roller that also functions as the steering roller with respect to the intermediate transfer belt, the following may occur.

Namely, in some cases of external forces applied respectively on the driving roller and the driven roller, a belt restraining force of the driven roller may be beyond a corrective capability produced by steering the driving roller.

If such a situation happens, the belt deviation control, which is performed by steering the driving roller, becomes insufficient. As a result, deformation such as waving and wrinkling may occur, or malfunction caused from a fully deviated belt may occur. Especially, after images are repeatedly created in the image forming apparatus, a surface of the driving roller becomes tainted with toners scattered from a transfer cleaner, which decreases the friction coefficient with respect to the intermediate transfer belt, and thus may make the malfunction mentioned above significant.

In addition, because a high transfer bias voltage is applied to the inner secondary transfer roller described above, a component of rubber may exude, even if only slightly, to the roller surface, so that the friction coefficient with respect to the intermediate transfer belt may be increased. Therefore, when the inner secondary transfer roller is configured as the driven roller, a belt restraining force produced by the driven roller tends to be beyond the belt deviation corrective capability due to the driving roller that also serves as the steering roller.

SUMMARY OF THE INVENTION

According to an embodiment, the present invention provides a belt driving apparatus. This belt driving apparatus includes: an endless belt; a steering roller and a supporting roller that support the endless belt rotatably along a circumferential direction of the endless belt; a tension roller that applies a tensional force on the endless belt supported by the supporting roller and the steering roller; a first load member that applies a first external force on the supporting roller through the endless belt; a second load member that applies a second external force on the steering roller through the endless belt; a controlling portion that changes alignment of the steering roller in relation to the supporting roller thereby to control a position of the endless belt along a width direction perpendicular to the circumferential direction.{j} In the belt driving apparatus, a relationship $\mu_1 (2T \sin(\theta_1/2)+f_1)<\mu_2(2T \sin(\theta_2/2)+f_2)$ is satisfied, where $\mu_1$ is a dynamic friction coefficient between the supporting roller and the endless belt, $\mu_2$ is a dynamic friction coefficient between the steering roller and the endless belt, $\theta_1$ is a winding angle of the endless belt with respect to the supporting roller, $\theta_2$ is a winding angle of the endless belt with respect to the steering roller, $f_1$ is the first external force applied to the supporting roller through the endless belt, $f_2$ is the second external force applied to the steering roller through the endless, and T is a tension force applied to the endless belt by the tension roller.

Further features of the present invention will become apparent from the following description of exemplary embodiments with reference to the attached drawings.

BRIEF DESCRIPTION OF THE DRAWINGS

FIGS. 10A and 10B are explanatory views explaining a rear end portion of a second framed in a raised position and in a lowered position in the fourth embodiment.

FIG. 13B is an explanatory view of a supporting mechanism of a tension roller in the fourth embodiment.

DESCRIPTION OF THE EMBODIMENTS

<First Embodiment>

Figure 1:
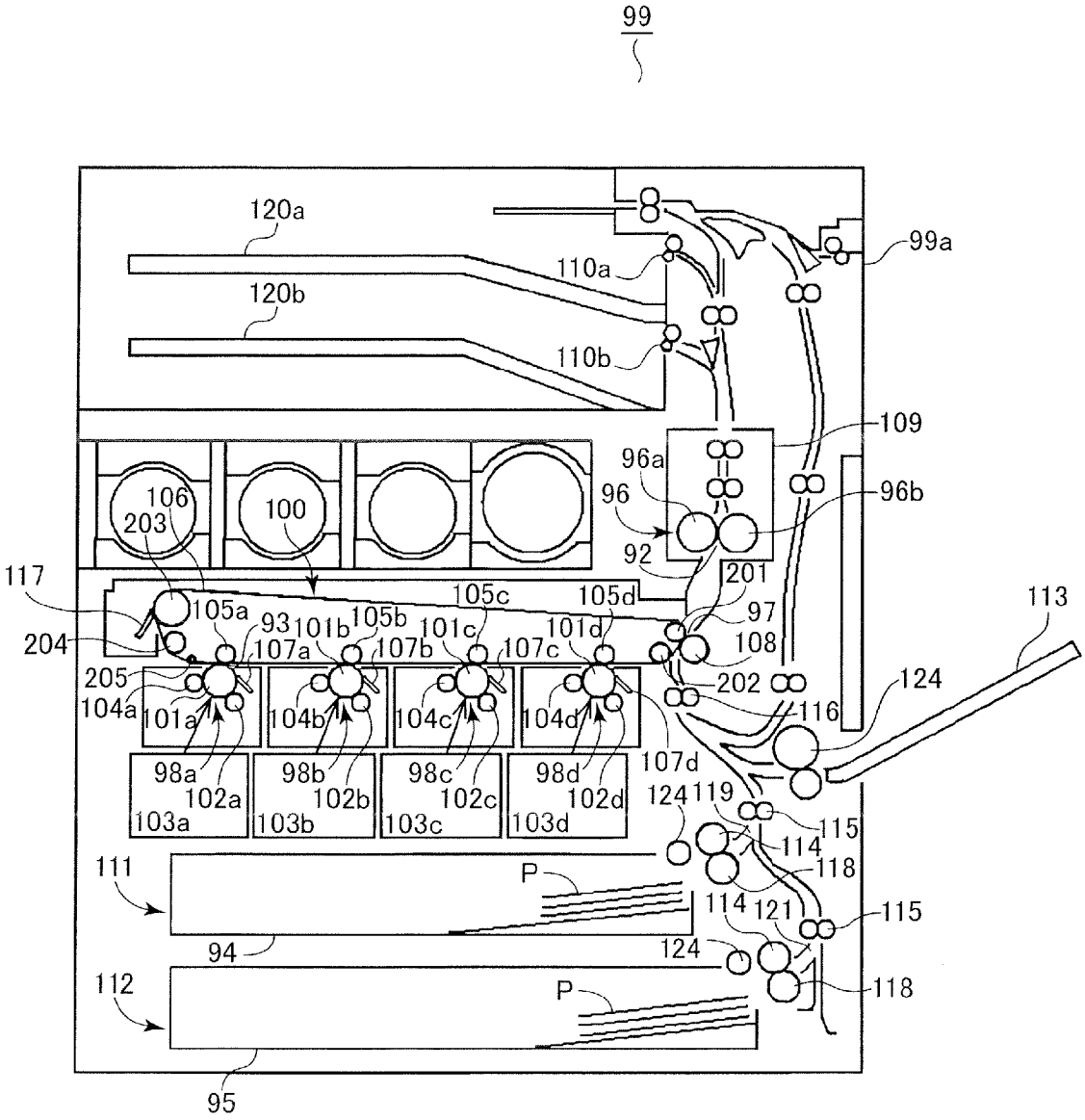
FIG. 1 is a schematic cross-sectional view illustrating schematic configurations of an image forming apparatus according to a first embodiment of the present invention.

An image forming apparatus provided with a belt driving apparatus, which are according to embodiments of the present invention, will be described in the following with reference to the accompanying drawings. The same or corresponding reference symbols are given to the same or corresponding parts, members, or portions throughout the drawings. FIG. 1 is a schematic cross-sectional view illustrating outlined configurations of an image forming apparatus 99 and an intermediate transfer belt unit 100 built-in in the image forming apparatus 99, which are according to the present invention. The image forming apparatus 99 may be a tandem type digital color printer of the intermediate transfer scheme.

<Configurations of Image Forming Apparatus>

The image forming apparatus 99*a* has a main body 99*a*, inside of which the intermediate transfer belt unit 100 serving as a belt driving apparatus is provided at a middle stage position along a vertical direction thereof. The intermediate transfer belt unit 100 changes an alignment of a steering roller 203 in relation to an inner secondary transfer roller 201, and controls a position of an intermediate transfer belt 106, which is an endless belt, in a width direction perpendicular to a circumferential direction of the intermediate transfer belt 106. The steering roller 203 functions as a driving roller in this embodiment.

Four image forming portions 98*a*, 98*b*, 98*c*, 98*d* are provided in respective positions from an upstream side to a downstream side along a rotational direction (an anti-clockwise direction in FIG. 1) of the intermediate transfer belt 106 in a lower part of the intermediate transfer belt unit 100. The image forming portions 98*a*, 98*b*, 98*c*, 98*d* are configured so as to create corresponding images on the intermediate transfer belt 106 during being driven.

Namely, the image forming portions 98*a*, 98*b*, 98*c*, 98*d* are capable of creating corresponding toner images of yellow, magenta, cyanogen, and black in this order.

The image forming portion 98*a*, 98*b*, 98*c*, 98*d* are provided with corresponding drum-type electro-photographic photoreceptive drums (referred to as "photoreceptive drums", hereinafter) 101*a*, 101*b*, 101*c*, 101*d*, which serve as latent image carriers. Each of the photoreceptive drums 101*a*-101*d* is configured so as to be rotatably driven in a clockwise direction in FIG. 1.

The intermediate transfer belt unit 100 has an inner secondary transfer roller 201 serving as a supporting roller, an idler roller 202, a supplementary roller 205, a tension roller 204, and the steering roller 203 serving as a driving roller, which are arranged according to predetermined positional relationship. By these rollers 201, 202, 203, 204, 205, the intermediate transfer belt 106 serving as the endless belt is stretched (or supported) so as to be rotatable along a circumferential direction thereof. The tension roller 204 applies an outward tensional force on the intermediate transfer belt 106.

Primary transfer rollers 105*a*, 105*b*, 105*c*, 105*d* are arranged between the idler roller 202 and the supplementary roller 205, and in an inner circumferential area of (or inside) the intermediate transfer belt 106. Both ends of the primary transfer rollers 105*a*-105*d* are rotatably supported by corresponding bearings 210*a*, 210*b*, 210*c*, 210*d* (see FIG. 2). Transfer biases are applied to the primary transfer rollers 105*a*-105*d* by corresponding bias applying units (not illustrated). The photoreceptive drums 101*a*, 101*b*, 101*c*, 101*d* are arranged respectively in positions opposite to the corresponding primary transfer rollers 105*a*, 105*b*, 105, 105*d*, with the intermediate transfer belt 106 placed in-between.

As for the intermediate transfer belt 106, a reverse surface (inside surface) thereof is pressed by the preliminary transfer rollers 105*a*-105*d*, and a front surface (an outside surface) thereof is in contact with the photoreceptive drums 101*a*, 101*b*, 101*c*, and 101*d* in the corresponding image forming portions 98*a*, 98*b*, 98*c*, 98*d*.

Primary transfer nip portions are formed as primary transfer portions 93 (FIG. 2) between the corresponding photoreceptive drums 101*a*, 101*b*, 101*c*, 101*d* and the intermediate transfer belt 106. The intermediate transfer belt 106 is driven to rotate in the counter-clockwise direction by the counter-clockwise directional rotation of the steering roller 203. A rotational speed (a process speed) of the intermediate transfer belt 106 is set to be substantially the same as a rotational speed of the photoreceptive drums 101*a*-101*d*.

Laser scanners 103*a*, 103*b*, 103*c*, 103*d*, which serve as exposure units, and primary electrostatic-charging rollers 102*a*, 102*b*, 102*c*, 102*d*, which serve as electrostatic-charging units, are provided around the corresponding photoreceptive drums 101*a*, 101*b*, 101*c*, 101*d* along the rotational direction. In addition, developing devices 104*a*, 104*b*, 104*c*, 104*d*, which serve as developing units, and cleaning blades 107*a*, 107*b*, 107*c*, 107*d*, which serve as photo-receptive body cleaning units, are provided around the corresponding photoreceptive drums 101*a*, 101*b*, 101*c*, 101*d*.

The laser scanners 103*a*, 103*b*, 103*c*, 103*d* input image signals of yellow, magenta, cyanogen, and black, respectively, and emit laser beams of corresponding colors on the surfaces of the corresponding photoreceptive drums 101*a*, 101*b*, 101*c*, 101*d* in accordance with the image signals, thereby to neutralize charges thereon and to create corresponding electrostatic latent images.

An outer secondary roller 108 is provided in a position opposite to the inner secondary transfer roller 201 so as to be in contact with the outside surface of the intermediate transfer belt 106. The intermediate transfer belt 106 is held by the outer secondary transfer roller 108 and the inner secondary transfer roller 201. The outer secondary transfer roller 108 composes as a first load member and transmits an external force to the inner secondary transfer roller 201 through the intermediate transfer belt 106. A secondary transfer nip portion is formed as a secondary transfer portion 97 between the inner secondary transfer roller 108 and the intermediate transfer belt 106.

The secondary transfer portion 97 transfers the toner images created on the intermediate transfer belt 106 to a recording material (sheet) P that has been sent from a feeding portion 111 or a feeding portion 112 (described later). A positive bias is applied to the outer secondary transfer roller 108 of the secondary transfer portion 97. Because the positive bias is applied to the secondary transfer portion 97 through the outer secondary transfer roller 108, the toner images of four colors on the intermediate transfer belt 106 are secondarily transferred to the recording material P that has been transported by a pair of resist rollers 116. In addition, a cleaning blade 117 serving as a belt cleaning member of a belt cleaning unit is arranged opposite to the steering roller 203 so as to be in contact with the outside surface of the intermediate transfer belt 106. The cleaning blade 117 composes a second load member that applies an external force to the steering roller 203 through the intermediate transfer belt 106.

A fixing unit 96 (see FIG. 1) is arranged downstream in relation to the secondary transfer portion 97 along a direction in which the recording member is transported. The fixing unit 96 includes a fixing roller 96*a* and a pressing roller 96*b*, and is accommodated in a casing 109. Moreover, a paper ejecting tray 120*a* and a pair of paper ejecting rollers 110*a*, which are arranged on an upper stage, and a paper ejecting tray 120*b* and a pair of paper ejecting rollers 110*b*, which are arranged on a lower stage, are provided downstream in relation to the fixing unit 96.

The recording material P on which the toner images have been secondarily transferred in the secondary transfer portion 97 is transported to a fixing nip portion 92 between the fixing roller 96*a* and the pressing roller 96*b*, and then heated and pressed by the fixing roller 96*a* and the pressing roller 96*b*. With this, the toner images are fused and fixed on the surface thereof.

Moreover, a feeding unit 111 that accommodates a paper feeding cassette 94 into which the record materials P are loaded is arranged in a lower portion of the main body 99*a*. In addition, a feeding unit 112 that accommodates a paper feeding cassette 95 into which the record materials P are loaded is arranged below the feeding unit 111. A manual feeding tray 113 is arranged on the right hand side of the main body 99*a* as illustrated in FIG. 1. In addition, a paper feeding roller 124 that feeds the recording material P loaded in the manual feeding tray 113 is arranged downstream in relation to the manual feeding tray 113.

In the feeding unit 111, the recording materials P in the paper feeding cassette 94 are sent out one by one to a transportation path 119 through the paper feeding roller 124, a feeding roller 114, and a retard roller 118, and then supplied to the secondary transfer portion 97 via a transportation unit that has a pair of the resist rollers 116 and the like. Moreover, in the feeding unit 112, the recording materials P in the paper feeding cassette 95 are sent out one by one to a transportation path 121 through the paper feeding roller 124, the feeding roller 114, and the retard roller 118, and then supplied to the secondary transfer portion 97 via the transportation unit.

<Action of Image Forming Apparatus>

In the image forming apparatus 99 configured as above, the toner images created on the photoreceptive drums 101*a*-101*d* are primarily transferred sequentially on the intermediate transfer belt 106 that rotates in the counter-clockwise direction.

The primary transfer of the toner images to the intermediate transfer belt 106 from the photoreceptive drums 101*a*-101*d* is realized by applying a positive bias on the respective primary transfer rollers 105*a*-105*d*. The toner image, which has been created of the four-color toner images overlapped over one another on the intermediate transfer belt 106, is forwarded to the secondary transfer portion 97.

On the other hand, the residual toners remaining respectively on the surfaces of the photoreceptive drums 101*a*, 101*b*, 101*c*, 101*d* after the primary transfer of the toner images are removed by the respective cleaning blades 107*a*, 107*b*, 107*c*, 107*d* (FIG. 1). In addition, the toners remaining on the intermediate transfer belt 106 after the secondary transfer to the recording material P are removed by the cleaning blade 117.

The removed toners are retrieved into a toner retrieval container(s) (not illustrated) through a toner retrieval path(s) (not illustrated).

<Configurations of Intermediate Transfer Belt Unit>

Figure 2:
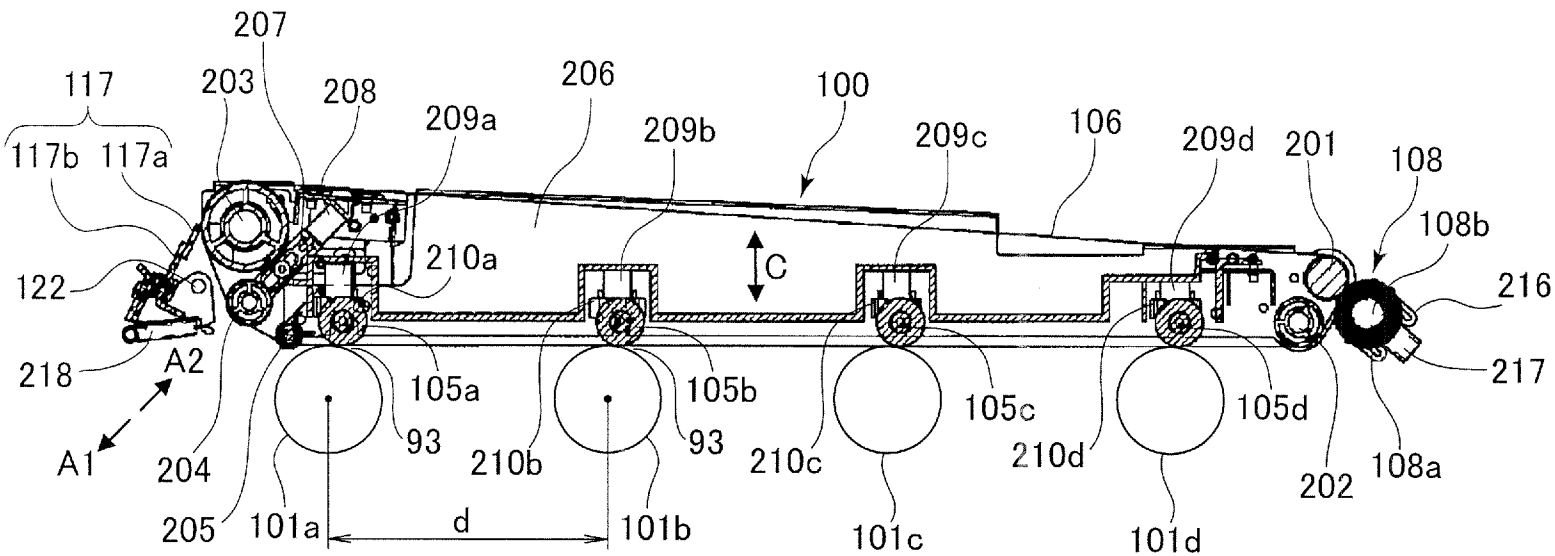
FIG. 2 is a cross-sectional view illustrating an intermediate transfer belt unit and vicinity thereof in the first embodiment.
Figure 3:
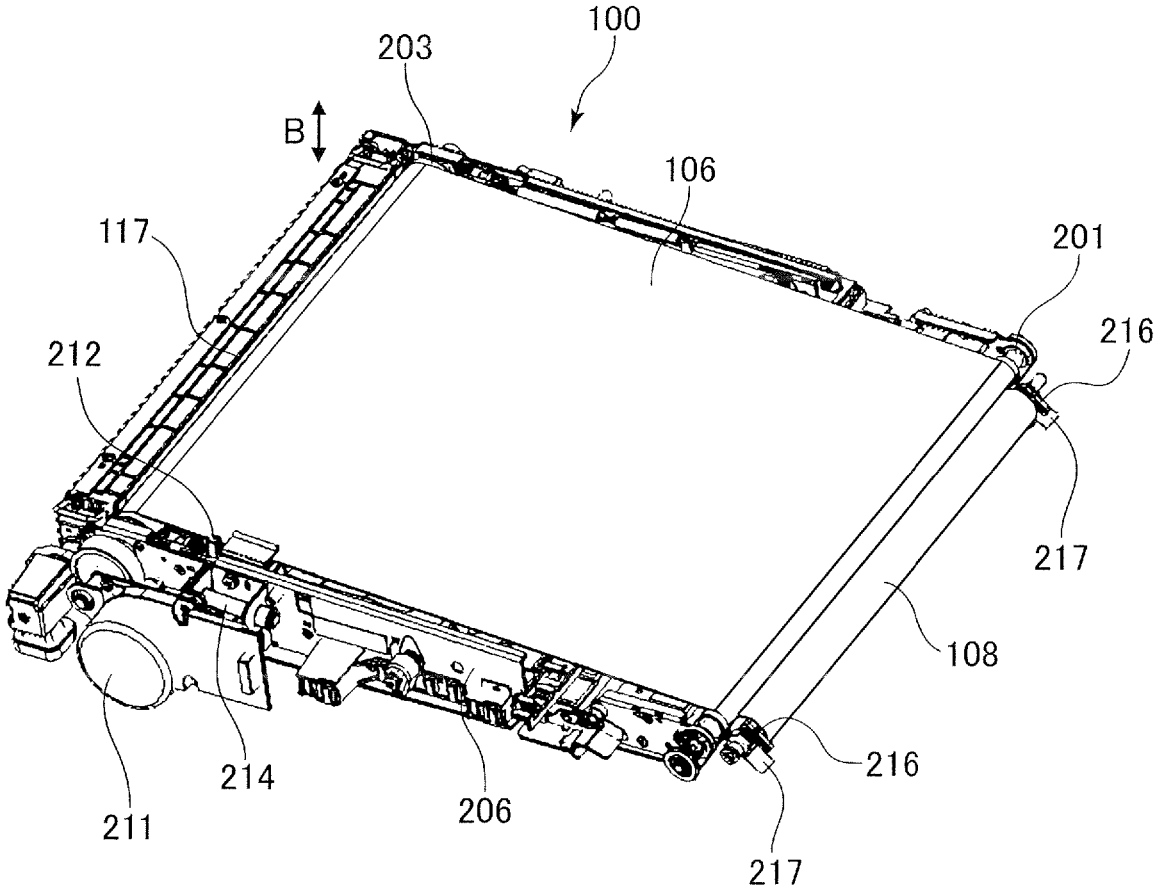
FIG. 3 is a perspective view illustrating the intermediate transfer belt unit and vicinity thereof in the first embodiment.

Next, configurations of the intermediate transfer belt unit 100 are explained with reference to FIG. 2 and FIG. 3. FIG. 2 is a cross-sectional view and FIG. 3 is a perspective view, both of which illustrate the intermediate transfer belt unit 100 and its vicinity in this embodiment.

The intermediate transfer belt 106, which is the endless belt, is made of, for example, polyimide. Referring to FIGS. 2 and 3, the inner secondary transfer roller 201, the idler roller 202, a supplementary roller 205, and the steering roller 203 are stretching the intermediate transfer belt 106, and are supported by a unit frame 206 of the intermediate transfer belt unit 100. In addition, the tension roller 204 is rotatably supported at both ends and their vicinities along the axial direction thereof by corresponding bearings 207. The bearings 207 are movable in relation the unit frame 206 along a direction shown by arrows A1 and A2 in FIG. 2. Incidentally, the bearing 207 on a front side is only illustrated and the bearing 207 on a rear side is omitted in FIG. 2.

The bearings 207 are biased by compression springs 208 in the direction indicated by the arrow A1 in FIG. 2. Therefore, even when variations are caused in a length of the intermediate transfer belt 106 and in sizes of other parts within dimensional tolerance, such variations are absorbed because the tension roller 204 can be slightly shifted in the directions of the arrows A1 or A2. With this, the intermediate transfer belt 106 can be stretched at substantially a constant tensional force of about 5 kgf (approximately 49.032 N).

The bearings 210*a*, 210*b*, 210*c*, 210*d* are guided in a vertical direction (a direction indicated by an arrow C) in FIG. 2 in relation the unit frame 206, and biased toward the corresponding photoreceptive drums 101*a*, 101*b*, 101*c*, 101*d* by corresponding compression springs 209*a*, 209*b*, 209*c*, 209*d*.

The steering roller 203 undergoes a driving force from a driving motor 211 (FIG. 3) and thus is rotated in the counterclockwise direction in FIG. 2, thereby to frictionally drive the intermediate transfer belt 106. In this case, the tension roller 204, the primary transfer rollers 105*a*-105*d*, the idler roller 202, and the inner secondary transfer roller 201 are accordingly driven to rotate by the rotation of the intermediate transfer belt 106.

In this embodiment, the photoreceptive drums 101*a*, 101*b*, 101*c*, 101*d* are arranged so that a pitch d (a distance between rotation centers of adjacent ones of the photoreceptive drum 101*a*, 101*b*, 101*c*, 101*d*) is, for example, 102 mm. A thickness of the intermediate transfer belt 106 is set to be, for example, 65 μm in this embodiment. In addition, a diameter of the steering roller 203 is set to be, for example, ϕ32.4 mm.

Here, because a speed of the intermediate transfer belt 106 is determined by a speed of a middle point thereof in its thickness direction, the intermediate transfer belt 106 is moved during one rotation of the steering roller 203 only by:

$$(32.4+0.065)\times\pi=102 \text{ mm}.$$

This distance moved is in agreement with the pitch d between the photoreceptive drums 101*a*-101*d*. In other word, the intermediate transfer belt 106 is moved only by the pitch d, during one rotation of the steering roller 203, in this embodiment.

Because the distance moved is in agreement with the pitch d, even when the speed of the intermediate transfer belt 106 is minutely changed in one rotation cycle of the steering roller 203 due to, for example, variations caused in the steering roller 203, the toner images of each color can be properly transferred on the same position of the intermediate transfer belt 106.

A diameter of the inner secondary transfer roller 201 is set to, for example, ϕ16 mm in this embodiment. This is because separability of the recording material P is further improved as the diameter of the inner secondary transfer roller 201 becomes smaller.

Diameters of the idler roller 202, the tension roller 204, and the supplementary roller 205 are set to, for example, ϕ18 mm, ϕ16 mm, and ϕ8 mm, respectively, in this embodiment. Because the intermediate transfer belt 106 is stretched as illustrated in FIG. 2, winding angles of the intermediate transfer belt 106 with respect to each roller are as follows. Namely, the winding angles are, for example, 114°, 116°, 60°, 46°, and 21° with respect to the steering roller 203, the inner secondary transfer roller 201, the idler roller 202, the tension roller 204, and the supplementary roller 205. Here, the winding angle corresponds to a central angle of a circular arc that is formed from a position where the intermediate transfer belt 106 starts coming in contact with a roller through a position where the intermediate transfer belt 106 leaves the roller. Incidentally, the intermediate transfer belt 106 is scarcely wound around the primary transfer rollers 105*a*-105*d*.

<Explanations on Belt Deviation Control>

Figure 4:
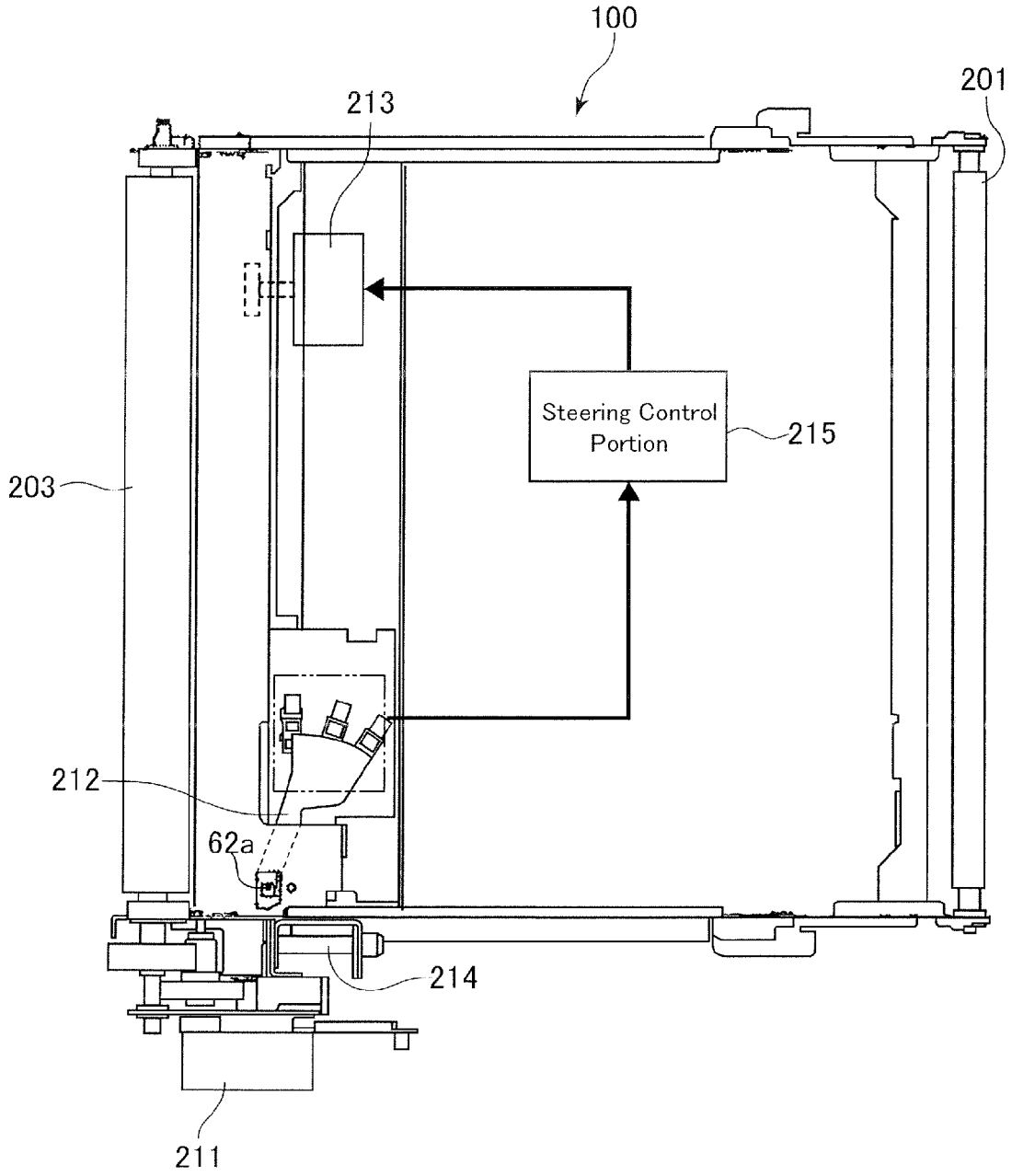
FIG. 4 is a plan view illustrating the intermediated transfer belt unit, from which an intermediate transfer belt is removed, in the first embodiment.

Next, explanations on the belt deviation control are made with reference to FIG. 3 and FIG. 4. Incidentally, FIG. 4 is a plan view of the intermediate transfer belt unit 100 where the intermediate transfer belt 106 is removed.

Referring to FIG. 3 and FIG. 4, a detection roller 62*a* is provided in a sensor flag 212 serving as a position detecting unit. The detection roller 62*a* is arranged so as to be in contact with one end surface (edge portion) of the intermediate transfer belt 106. When the intermediate transfer belt 106 is deviated along the axial direction (the longitudinal direction) of the steering roller 203, the inner secondary transfer roller 201 serving, or the like, which serve as the stretching roller, the sensor flag 212 moves (or pivots) in accordance with the movement of the end surface of the intermediate transfer belt 106. In this case, a steering control portion 215 always observes a position along the axial direction (the longitudinal direction) of the intermediate transfer belt 106 based on the position of the sensor flag 212. Incidentally, the "stretching roller" includes the idler roller 202, the tension roller 204, and the supplementary roller 205, in addition the inner secondary transfer roller 201 and the steering roller 203 that have been so referred to above.

The steering roller 203 is configured so to be capable of tilting with a pivotal shaft 214 arranged in a front side of the apparatus as a supporting point by a steering motor 213. In a word, the steering roller 203 is configured so that a rear end portion thereof in FIG. 3 (an upper end in FIG. 4) can be moved along the arrow B (a direction perpendicular to the paper surface of FIG. 4) within a predetermined range. The steering control portion 215 provided in the intermediate transfer belt unit 100 includes a central processing unit (CPU), a read only memory (ROM), a random access memory (RAM) and the like (not illustrated). The steering control portion 215 inputs a detection signal from the sensor flag 212, and controls the steering motor 213 in accordance with the detection signal.

Namely, when the sensor flag 212 detects that the intermediate transfer belt 106 is deviated beyond a predetermined range along the axial direction (the longitudinal direction), the steering control portion 215 moves the steering motor 213 thereby to place the intermediate transfer belt 106 in the center along the axial direction.

For this purpose, the steering roller 203 performs a steering (tilting) motion.

Specifically, in this steering motion, when the intermediate transfer belt 106 is deviated closer to a front side exceeding a predetermined range, the steering roller 203 is tilted so that the rear end portion thereof is raised. On the other hand, when the intermediate transfer belt 106 is deviated closer to a rear side beyond a predetermined ranged, the steering roller 203 is tilted so that the rear end portion thereof is lowered, in this steering motion. With such actions, the intermediate transfer belt 106 is constantly placed in the center along the axial direction of the steering roller 203, and driven under a proper belt deviation control.

<Explanations on Forces Applied from Outside on Intermediate Transfer Belt Unit>

Next, forces applied from outside on the intermediate transfer belt 106 are explained with reference to FIGS. 1 through 3.

A first load is applied from outside to the inner secondary transfer roller 201 through the intermediate transfer belt 106 by the outer secondary transfer roller 108.

As illustrated in FIG. 2, the outer secondary transfer roller 108 has a metal shaft 108*b* and has an electrically conductive sponge rubber layer 108*a* provided on a surface of the metal shaft 108*b*. As illustrated in FIG. 2 and FIG. 3, the outer secondary transfer roller 108 is rotatably supported at both ends along the axial direction of the metal shaft 108*b* by bearings 216, 216. These bearings 216, 216 are pressed onto the inner secondary transfer roller 201 at a pressure of, for example, 3.5 kgf (approximately 34.322 N) by compression springs 217.

While pressures of the compression springs 217 amount to as much as 7 kgf (approximately 68.645 N) in total, actual pressures may be estimated to 6.5 kgf (approximately 63.742 N) because the electrically conductive sponge rubber 108*a* is deformed.

As illustrated in FIG. 2, a second load is applied from outside to the steering roller 203 through the intermediate transfer belt 106 by the cleaning blade 117.

The cleaning blade 117 includes a metal plate 117*b* and a sheet 117*a* that is affixed on an upper end portion of the metal plate 117*b*. The sheet 117*a* is, for example, 2 mm thick, and made of urethane rubber, in this embodiment. The metal plate 117*b* is biased toward the center of the steering roller 203 by a tension spring 218 with the aid of a pivotal shaft 122 serving as a supporting point. The pressure applied to the steering roller 203 by the cleaning blade 117 is set to, for example, approximately 2.0 kgf (approximately 19.613 N) in total.

<Explanations on Materials of Stretching Roller and Friction Coefficient with Respect to Intermediate Transfer Belt>

Next, explanations are made about a friction coefficient of the inner secondary transfer roller 201, the steering roller 203, and the like with respect to the intermediate transfer belt 106, and materials of these rollers 201, 203, and the like.

Figure 5A:
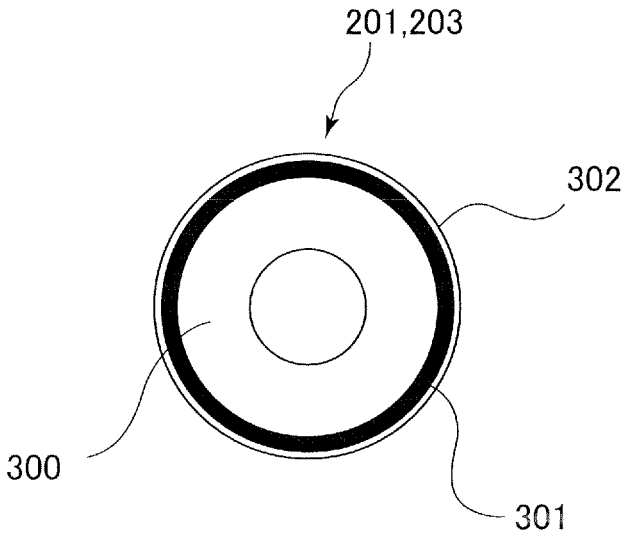
FIG. 5A is a side view of a driving roller and an inner secondary transfer roller in the first embodiment.

FIG. 5A is a side view of the steering roller 203 and the inner secondary transfer roller 201.

Referring to FIG. 5A, each of the inner secondary transfer roller 201 and the steering roller 203 includes a metal shaft 300 and a rubber layer 301 provided on the surface of the metal shaft 300. The rubber layer 301 is made of an electrically conductive ethylene-propylene-diene (EPDM) rubber, in this embodiment. The inner secondary transfer roller 201 further includes a coating layer 302, which has been deposited by a coating process described later, on the rubber layer 301. On the other hand, no coating process has been applied to the surface of the rubber layer 301 of the steering roller 203, and thus the steering roller 203 has no layers on the rubber layer 301.

Each of the idler roller 202, the tension roller 204, and the supplementary roller 205 has an aluminum-made outer circumferential surface, which comes in contact with the intermediate transfer belt 106.

As described above, the inner secondary transfer roller 201 illustrated in FIG. 5A includes the metal shaft 300 in the center, and the rubber layer 301 made of EPDM on the surface of the metal shaft 300. In addition, the coating process is performed on the surface of the rubber layer 301, so that the coating layer 302, which contains silicone, is formed on the rubber layer 301. A thickness of the coating layer 302 formed by the coating process is set to, for example, about 10 μm. The coating layer 302 has electric conductivity. Electric resistance from the surface of the inner secondary transfer roller 201 (i.e., the coating layer 302) through the metal shaft 300 is set to, for example, $1\times10^5\Omega$ or smaller.

A dynamic friction coefficient of the steering roller 203 with respect to the intermediate transfer belt 106 is set to, for example, about 1.5. In addition, a dynamic friction coefficient of the inner secondary transfer roller 108 with respect to the intermediate transfer belt 106 is set to, for example, about 0.2. Moreover, dynamic friction coefficients of the idler roller 202, the tension roller 204, and the supplementary roller 205 are set to, for example, about 0.1.

Incidentally, the dynamic friction coefficient is measured as follows. First, the intermediate transfer belt 106 in the form of a strip is placed on a stage. Then, a pressure of, for example, 100 gf (approximately 0.980 N) is applied by a roller, which is a subject to the measurement, to the strip-like intermediate transfer belt placed on the stage. Next, while the roller as the subject is rotated at a rotational speed, which is to be employed in an actual use, a force applied to the intermediate transfer belt 106 is measured by a digital force gauge. When a measurement value of the digital force gauge is assumed as F (gf), the dynamic friction coefficient is F/10.

<Force Acted Between Roller and Intermediate Transfer Belt>

Figure 5B:
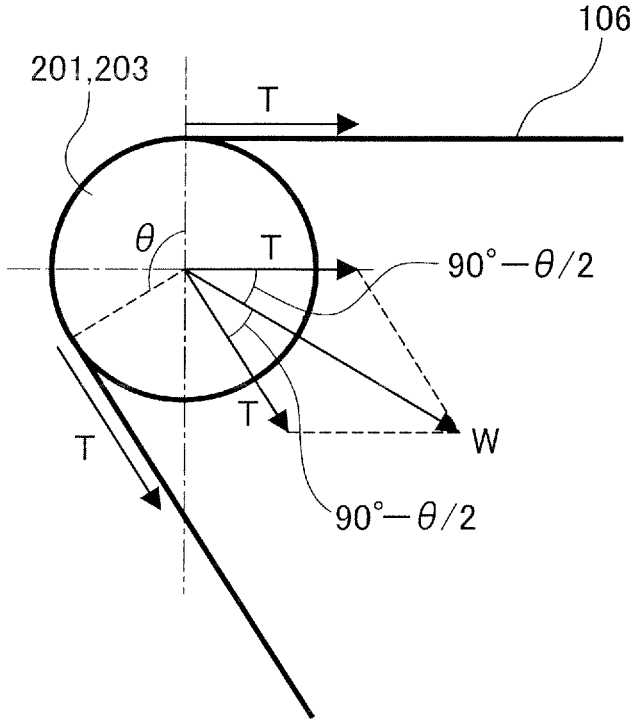
FIG. 5B is an explanatory view explaining a force applied to a stretching roller by a belt tension.

Here, explanations are made about a force acted between a roller and the intermediate transfer belt 106 with reference to FIG. 5B, which is an explanatory view for explaining a force applied to the stretching roller by belt tension.

As illustrated in FIG. 5B, when a winding angle of the intermediate transfer belt 106 with respect to (or wound around) the stretching rollers such as the inner secondary transfer roller 201 and the steering roller 203 is assumed to be θ, a force applied the stretching roller by a belt tension force T is expressed as follows:

$$W=2T\cos(90°-\theta/2)=2T\sin(\theta/2) \quad (1)$$

A force F applied to the intermediate transfer belt 106 by each of the stretching rollers is expressed by the following expression (2): where, μ is a dynamic friction coefficient between the intermediate transfer belt 106 and each surface of the stretching rollers; and f is an external force applied to each of the stretching rollers.

$$F=\mu(W+f)=\mu(2T\sin(\theta/2)+f) \quad (2)$$

Therefore, the following expressions are obtained for each of the stretching rollers. As for the steering roller 203, a force $F_d$ applied to the intermediate transfer belt 106 by the steering roller 203 is expressed by the following expression (3):

$$F_d=1.5\times(2\times5\times\sin(114°/2)+2.0)=15.6 \quad (3)$$

As for the inner secondary transfer roller 201, a force $F_{tr}$ applied to the intermediate transfer belt 106 by the inner secondary transfer roller 201 is expressed by the following expression (4):

$$F_{tr}=0.2\times(2\times5\times\sin(116°/2)+6.5)=3.0 \quad (4)$$

As for the idler roller 202, a force $F_i$ applied to the intermediate transfer belt 106 by the idler roller 202 is expressed by the following expression (5):

$$F_i=0.1\times2\times5\times\sin(60°/2)=0.5 \quad (5)$$

As for the tension roller 204, a force $F_i$ applied to the intermediate transfer belt 106 by the tension roller 204 is expressed by the following expression (6):

$$F_t=0.1\times2\times5\times\sin(46°/2)=0.4 \quad (6)$$

As for the supplementary roller 205, a force $F_s$ applied to the intermediate transfer belt 106 by the supplementary roller 205 is expressed by the following expression (7):

$$F_i=0.1\times2\times5\times\sin(21°/2)=0.2 \quad (7)$$

From the above, it has been found that a relationship of $F_d>>F_{tr}>>F_i>F_t>F_s$ is satisfied. Therefore, it is found that among the stretching rollers, the steering roller 203, which serves as the driving roller and is tilted thereby to control deviation of the intermediate transfer belt 106, applies the largest force on the intermediate transfer belt 106.

After images are repeatedly created in the image forming apparatus 99, or after repetitive usages of the image forming apparatus 99, the following can be expected.

Namely, when it is assumed that the dynamic friction coefficient between the intermediate transfer belt 106 and the surface of the steering roller 203 is reduced to about 1.0, which is about two-thirds of the initial value, and the dynamic friction coefficient between the intermediate transfer belt 106 and the surface of the inner secondary transfer roller 201 is increased to about 0.3, which is about 1.5 times of the initial value, a relationship $F_d>F_2$ remains satisfied. Therefore, a sufficient steering capability can be maintained, and the belt deviation control for the intermediate transfer belt 106 can be assuredly performed.

In this embodiment described above, the coating process is performed on the surface of the inner secondary transfer roller 201 serving as the supporting roller. With this, the dynamic friction coefficient of the inner secondary transfer roller 201 with respect to the intermediate transfer belt 106 becomes smaller than the dynamic friction coefficient of the surface of the steering roller 203 with respect to the intermediate transfer belt 106. Namely, by satisfying the following expression (8), the belt deviation control for the intermediate transfer belt 106 can be assuredly performed.

$$\mu_d(2T\sin(\theta_d/2)+f_d)>\mu_{tr}(2T\sin(\theta_{tr}/2)+f_{tr}) \quad (8)$$

In other words, the intermediate transfer belt unit 100 serving as the belt driving apparatus is configured so as to satisfy:

$$\mu_1(2T\sin(\theta_1/2)+f_1)<\mu_2(2T\sin(\theta_2/2)+f_2) \quad (8'),$$

wherein $\mu_1$ is a dynamic friction coefficient between the inner secondary transfer roller 201 and the intermediate transfer belt 106 (or the supporting roller and the endless belt); $\mu_2$ is a dynamic friction coefficient between the steering roller 203 and the intermediate transfer belt 106;

$\theta_1$ is a winding angle of the intermediate transfer belt 106 wound around the inner secondary transfer roller 201; $\theta_2$ is a winding angle of the intermediate transfer belt 106 wound around the steering roller 203; $f_1$ is an external force applied to the inner secondary transfer roller 201 through the intermediate transfer belt 106;

$f_2$ is an external force applied to the steering roller 203 through the intermediate transfer belt 106; and T is a tension force applied to the intermediate transfer belt 106 by the tension roller 204.

From the above configurations, even when the force applied to the inner secondary transfer roller 201 by the outer secondary transfer roller 108 exceeds the force applied to the steering roller 203 by the cleaning blade 117, the following effects or advantages are obtained. Namely, a belt restraining force exerted by the inner secondary transfer roller 201 can be assuredly prevented from exceeding a belt deviation corrective capability due to the steering motion of the steering roller 203. Therefore, the intermediate transfer belt unit 100 and the image forming apparatus 99 can be provided that can assuredly perform the belt deviation control, substantially without being affected by a magnitude relationship between the forces applied from outside to the steering roller 203 and the inner secondary transfer roller 201 through the intermediate transfer belt 106.

In this embodiment, the surface of the inner secondary transfer roller 201 is formed so that the relationship between the dynamic friction coefficients $\mu_1$ and $\mu_2$ satisfies $\mu_1<\mu_2$. In addition, each of the inner secondary transfer roller 201 and the steering roller 203 includes the metal shaft 300 placed in the center and the rubber layer 301 provided on the outer circumference of the metal shaft 300. Moreover, the inner secondary transfer roller 201 includes the coating layer 302 on the rubber layer 301. These configurations enhance preventive effects that prevent the belt restraining force by the inner secondary transfer roller 201 from exceeding the belt deviation corrective capability due to the steering motion of the steering roller 203.

In addition, the external force $f_1$ acts on the inner secondary transfer roller 201 from the outer secondary transfer roller (a first load member) 108 via the intermediate transfer belt 106. Moreover, the external force $f_2$ acts on the steering roller 203 from the cleaning blade (a second load member) 117 via the intermediate transfer belt 106. With this, the normal forces with respect to the inner secondary transfer roller 201 and the steering roller 203, respectively, can be assured.

The configurations in the first embodiment described above are also applicable to a fourth embodiment described later.

Incidentally, although the coating process utilizing a material containing silicone is performed on the surface of the inner secondary transfer roller 201 in this embodiment, other coating process may be performed rather than the above-explained coating process, as long as the friction coefficient of the surface of the rubber layer 301 is reduced. For example, the coating layer 302 may be formed by performing a coating process utilizing a material containing fluorine in the place of silicone. This may provide another option of the coating process that forms the coating layer 302.

In addition, various values regarding the roller diameters, the belt thickness, the external forces, or the like have been discussed in this embodiment only for exemplifying purposes. Apparently, the present disclosure is not limited by those values.

While the intermediate transfer belt 106 in the image forming apparatus 99 is described in this embodiment as an example, the present disclosure is not limited to the described embodiment. The same effects or advantages are apparently obtained in any belt driving apparatus that rotates an endless belt stretched by a plurality of stretching rollers.

<Second Embodiment>

Figure 6:
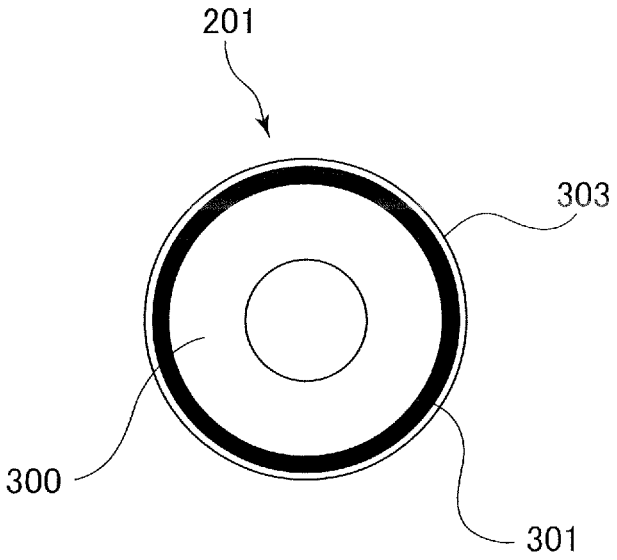
FIG. 6 is a side view illustrating an inner secondary transfer roller in a second embodiment according to the present invention.

Next, a second embodiment according to the present invention is described with reference to FIG. 6. FIG. 6 is a side view illustrating an inner secondary transfer roller 201 in this embodiment. Parts, members, or portions of this embodiment are substantially the same as the parts, members, or portions of the first embodiment, except for the inner secondary transfer roller 201. Therefore, the same or corresponding reference symbols are given to the same or corresponding parts, members, or portions as those in the precedent embodiment, and undue explanations are omitted.

Referring to FIG. 6, the inner secondary transfer roller 201 of this embodiment includes the metal shaft 300, the rubber layer 301 that is made of EPDM on the surface of the metal shaft 300, and a tube 303 made of polytetrafluoroethylene (PFA) on the surface of the rubber layer 301. A thickness of the tube 303 is, for example, about 50 μm. Namely, each of the inner secondary transfer roller (a supporting roller) 201 and the steering roller 203 includes the metal shaft 300 in the center and the rubber layer 301 formed on the outer circumference of the metal shaft 300 in this embodiment.

In this embodiment, a dynamic friction coefficient of the inner secondary transfer roller 201, which includes the tube 303 made of PFA on the surface, with respect to the intermediate transfer belt 106 is set to, for example, about 0.1. Therefore, a force $F_{tr}$ applied to the intermediate transfer belt 106 by the inner secondary transfer roller 201 is expressed by the following expression (9):

$$F_{tr}=0.1\times(2\times5\times\sin(116°/2)+6.5)=1.5 \quad (9)$$

Therefore, a relationship of $F_d>>F_{tr}$ is satisfied also in this embodiment, as understood from the explanations made for the first embodiment, and the force applied to the intermediate transfer belt 106 by the steering roller 203 is sufficiently greater than the force applied to the intermediate transfer belt 106 by the inner secondary transfer roller 201. In such a manner, the relationship of $F_d>>F_{tr}>>F_i>F_t>F_s$ is satisfied in this embodiment.

Therefore, in this embodiment, the dynamic friction coefficient of the surface of the inner secondary transfer roller 201 with respect to the intermediate transfer belt 106 can be made smaller than the dynamic friction coefficient of the surface of the steering roller 203 with respect to the intermediate transfer belt 106 by forming the tube 303 made of PFA on the surface of the inner secondary transfer roller 201.

With this, configurations that assuredly enable the belt deviation control can be obtained by satisfying the aforementioned expressions (8), (8'), substantially without being affected from a magnitude relationship between the forces applied from outside to the steering roller 203 and the inner secondary transfer roller 201.

In addition, the tube 303 made of PFA in this embodiment has a greater wear resistance, compared to the coating layer 302 made of EPDM on the surface of the rubber layer 301 in the first embodiment. Moreover, even if components of EPDM that forms the rubber layer 301 may slightly exude when high transfer bias is applied thereon, the components are blocked by the tube 303 and thus are not precipitated on the tube 303 made of PFA. Therefore, only a slight change takes place in the friction coefficient over a long period of time, so that a further stable performance can be obtained.

Incidentally, various values regarding the thickness and friction coefficient of the tube 303 made of PFA have been mentioned in this embodiment only for exemplifying purposes. Apparently, the present disclosure is not limited by those values.

The configurations in this embodiment described above are also applicable to a fourth embodiment described later.

<Third Embodiment>

Figure 7:
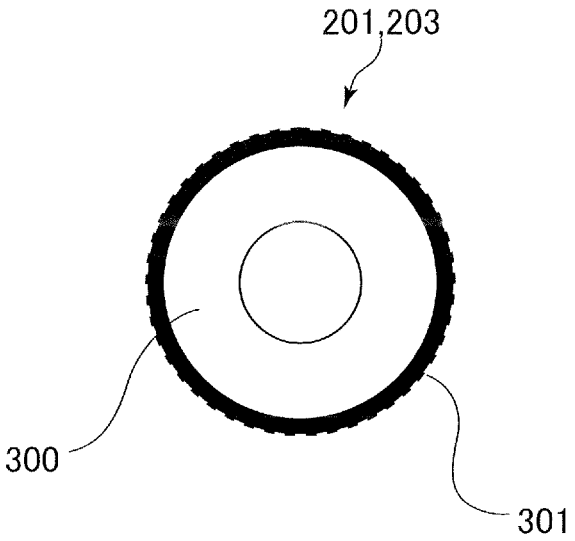
FIG. 7 is a side view illustrating a driving roller and an inner secondary transfer roller in a third embodiment according to the present invention.

Next, a third embodiment according to the present invention is described with reference to FIG. 7. FIG. 7 is a side view illustrating an inner secondary transfer roller 201 and a steering roller 203 in this embodiment. Parts, members, or portions of this embodiment are the same as the parts, members, or portions of the first embodiment, except for the inner secondary transfer roller 201. Therefore, the same or corresponding reference symbols are given to the same or corresponding parts, members, or portions as those in the precedent embodiments, and undue explanations are omitted.

In this embodiment, the steering roller 203 illustrated in FIG. 7 is provided with the rubber layer 301 that is made of EPDM on the surface of the metal shaft 300.

A surface roughness of the rubber layer 301 of the steering roller 203 is set to, for example, about Ra 1.5.

In addition, also the inner secondary transfer roller 201 (FIG. 7) is provided with the rubber layer 301 that is made of EPDM on the surface of the metal shaft 300.

The surface of the rubber layer 301 of the inner secondary transfer roller 201 undergoes an embossing process so that a surface roughness of the embossed surface is about Ra 2.5.

In this embodiment, because the embossing process is performed on the surface of the rubber layer 301 of the inner secondary transfer roller 201 thereby to roughen the surface, the dynamic friction coefficient of the inner secondary transfer roller 201 with respect to the intermediate transfer belt 106 is about 0.4, which is smaller than the dynamic friction coefficient (1.5) of the steering roller 203 with respect to the intermediate transfer belt 106.

Therefore, the force $F_{tr}$ applied to the intermediate transfer belt 106 by the inner secondary transfer roller 201 is expressed by the following expression (10):

$$F_{tr}=0.4\times(2\times5\times\sin(116°/2)+6.5)=7.5 \quad (10)$$

Therefore, a relationship of Fd>>Ftr is satisfied also in this embodiment, as understood from the explanations made for the first embodiment, and the force applied to the intermediate transfer belt 106 by the steering roller 203 is sufficiently greater than the force applied to the intermediate transfer belt 106 by the inner secondary transfer roller 201. In such a manner, the relationship of Fd>>Ftr>>Fi>Ft>Fs is satisfied in this embodiment. Therefore, the belt deviation control for the intermediate transfer belt 106 can be assuredly performed also in this embodiment.

As described above, each of the inner secondary transfer roller 201 and the steering roller 203 includes the metal shaft 300 in the center and the rubber layer 301 formed on the outer circumference of the metal shaft 300 in this embodiment. In addition, the surface of the rubber layer 301 of the inner secondary transfer roller 201 has greater roughness than the surface of the rubber layer 301 of the steering roller 203, because the embossing process is performed on the surface of the rubber layer 301 of the inner secondary transfer roller 201. In such a manner, the dynamic friction coefficient of the surface of the inner secondary transfer roller 201 with respect to the intermediate transfer belt 106 is smaller than the dynamic friction coefficient of the surface of the steering roller 203 with respect to the intermediate transfer belt 106 by making the surface roughness of the inner secondary transfer roller 201 greater.

From the above, the aforementioned expressions (8), (8') can be satisfied also in this embodiment. Therefore, the belt deviation control can be assuredly performed for the intermediate transfer belt 106, even when a force applied from outside to other roller portions such as the inner secondary transfer roller 201 through the endless belt such as the intermediate transfer belt 106 is greater than a force applied from outside to a steering roller portion such as the steering roller 203 through the endless belt such as the intermediate transfer belt 106. Therefore, configurations that assuredly enable the belt deviation control can be obtained, substantially without being affected from a magnitude relationship between forces applied from outside to the steering roller 203 and the inner secondary transfer roller 201.

In addition, the surface of the inner secondary transfer roller 201 can be roughened when the rubber layer 301 of the inner secondary transfer roller 201 is formed. Therefore, a subsequent process for adjusting the dynamic friction coefficient, which is performed in the first and the second embodiments, is unnecessary, thereby to enable cost reductions.

Incidentally, various values of the surface roughness and the friction coefficient with respect to the intermediate transfer belt 106 have been discussed regarding the inner secondary transfer roller 201 in this embodiment. Those values are mentioned only for exemplifying purposes. Apparently, the present disclosure is not limited by the values.

The configurations in this embodiment described above are also applicable to a fourth embodiment described later.

<Fourth Embodiment>

Next, a fourth embodiment according to the present invention is explained with reference to FIGS. 8 through 18. This embodiment makes it possible to increase the external forces $f_d$, $f_1$ that are applied to the steering roller 203 through the intermediate transfer belt 106 in following expressions (8), (8'), which are described in the first embodiment.

$$\mu d(2T\sin(\theta d/2)+fd)>\mu tr(2T\sin(\theta tr/2)+ftr) \quad (8)$$

$$\mu_1(2T\sin(\theta_1/2)+f_1)<\mu_2(2T\sin(\theta_2/2)+f_2) \quad (8')$$

In this embodiment, by allowing a steering supplementary roller 90 to be in contact with the steering roller 203, which performs the belt deviation control, from outside, the following effects or advantages are obtained, in addition the effects or advantages obtained in the first embodiment. Namely, even when the inner secondary transfer roller 201 may be deformed after repetitions of image forming, stable running performance of the intermediate transfer belt 106 is assured. Incidentally, configurations of this embodiment are substantially the same as those in the first embodiment, except for configurations for increasing the external forces $f_d$, $f_1$. Therefore, the same or corresponding reference symbols are given to the same or corresponding parts, members, or portions in the first embodiment, and different configurations are explained in detail.

<Entire Configurations of Intermediate Transfer Body>

Figure 8:
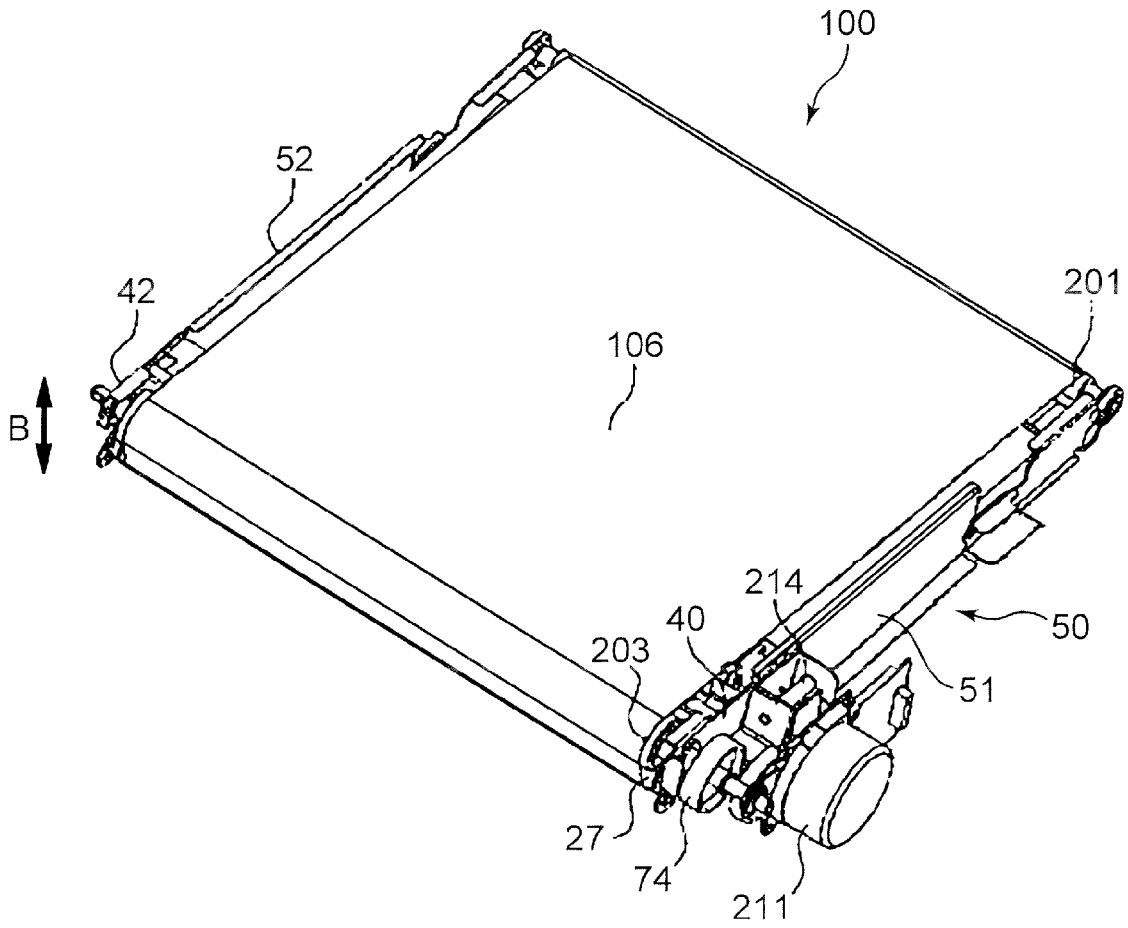
FIG. 8 is a perspective view illustrating an intermediate transfer belt unit in a fourth embodiment according to the fourth embodiment.

Referring to FIG. 8, the intermediate transfer belt unit 100 includes a second frame 40 that rotatably supports both ends of the steering roller 203. The driving motor 211 is fixed in one end side of the second frame 40.

A driving force of the driving motor 211 is transmitted to the steering roller 203 on the second frame 40.

Figure 9:
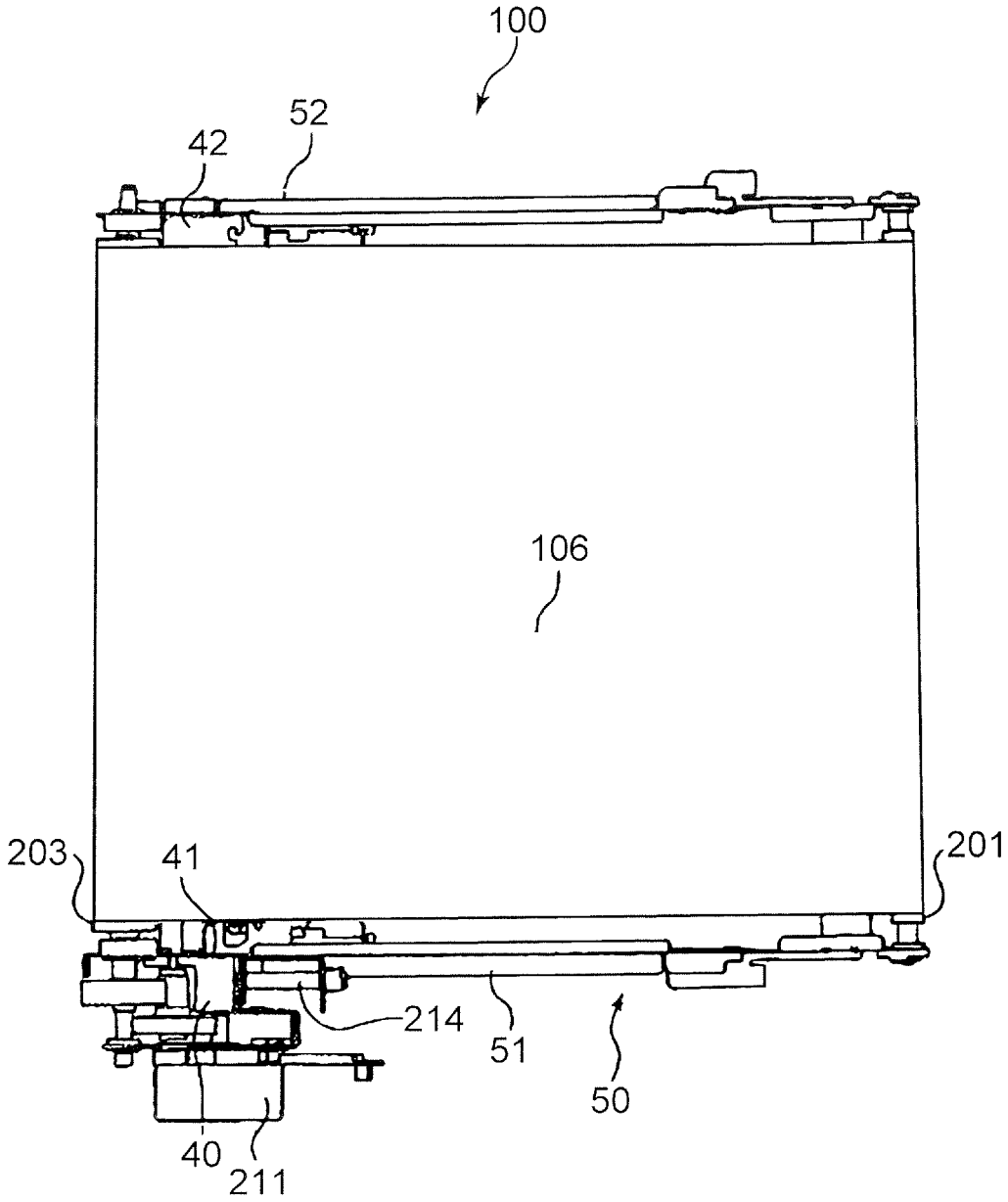
FIG. 9 is a plan view illustrating an intermediate transfer belt unit in the fourth embodiment according to the present invention.

Referring to FIG. 8 and FIG. 9, the intermediate transfer belt unit 100 includes a first frame 50 in addition to the second frame 40. The first frame 50 has a shape of a frame and rotatably supports both ends of the inner secondary transfer roller 201.

The second frame 40 is supported so as to be tiltable in relation to the first frame 50. The second frame 40 has a shape of a frame, and rotatably supports both ends of the steering roller 203.

A side plate 41 on one side of the second frame 40 is supported by the first frame 50 so as to be pivotable around a pivotal shaft 214. In addition, a side plate 42 on the other side of the second frame 40 is supported so as to be movable along an edge portion of the side plate 52 on the other side of the first frame 50.

FIG. 10 is an explanatory view illustrating the second frame 40 with the other side thereof being raised or lower. Specifically, FIG. 10(*a*) illustrates the other end of the second frame 40 in a raised position, and FIG. 10(*b*) illustrates the other end of the second frame 40 in a lowered position. As illustrated in FIG. 10(*a*), the side plate 52 on the other side of the first frame 50 is provided with guiding grooves 55, 56 along a vertical (upward-downward) direction. Guiding pins 45, 46 that are fixed on the second frame 40 are slidably guided along the corresponding guiding grooves 55, 56. With this, as illustrated in FIG. 10(*b*), the other side (the upper side in FIG. 9) of the second frame 40 is configured so as to be movable upward or downward within movable ranges of the guiding pins 45, 46 in the corresponding guiding grooves 55, 56.

Figure 11:
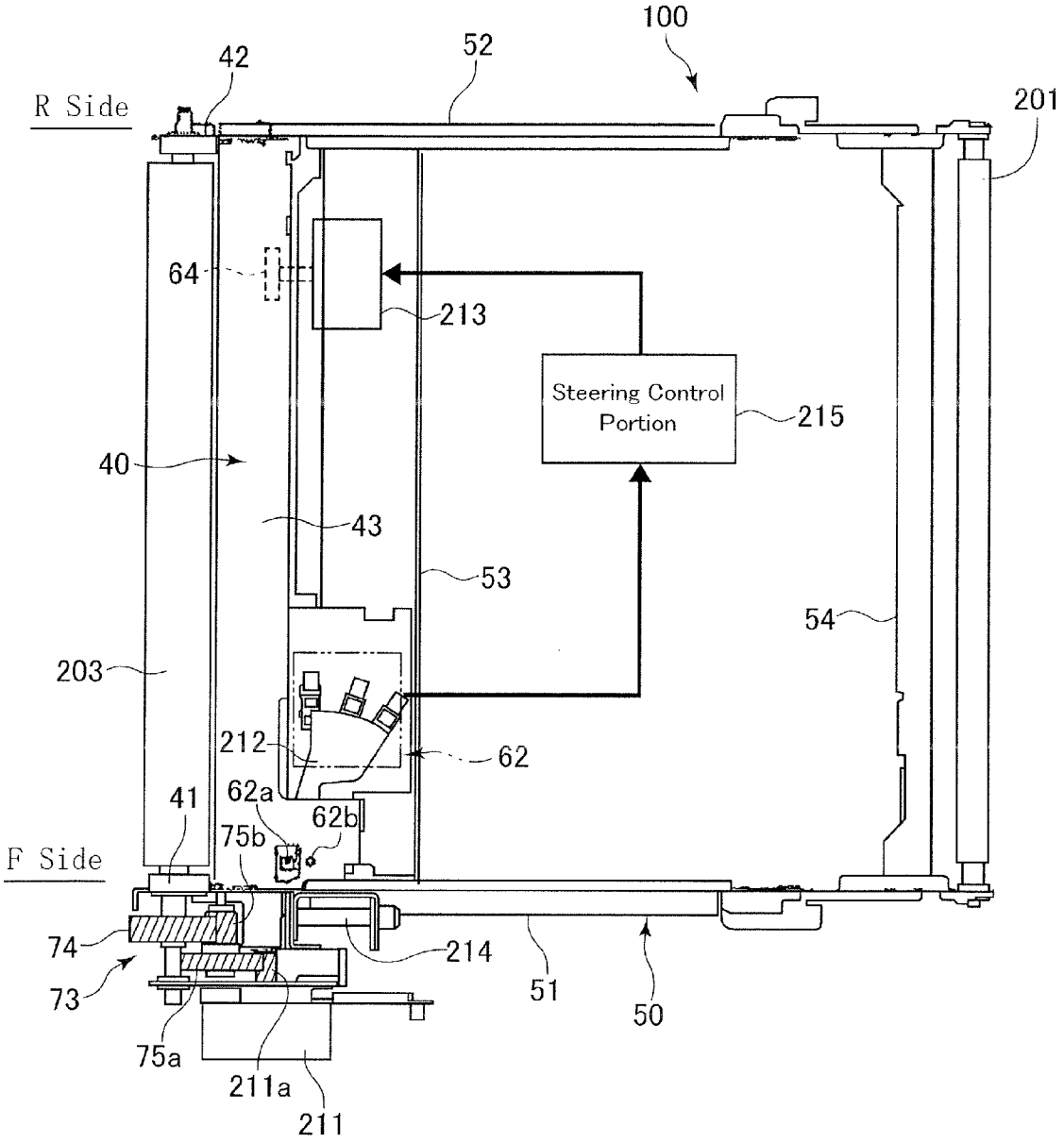
FIG. 11 is an explanatory view explaining a planar arrangement of a first frame and the second frame in the fourth embodiment.

FIG. 11 is a plan view illustrating the intermediate transfer belt unit 100 of FIG. 9. In this drawing, the intermediate belt 106 is omitted for explanatory purposes. As illustrated in FIG. 11, the side plates 51, 52 of the first frame 50 are mutually linked at both end sides by beam plates 53, 54. The side plates 41, 42 of the second frame 40 are mutually linked by both end portions of a beam plate 43.

The second frame 40 that supports the driving motor 211 and the steering roller 203 is in the form of square frame and has necessary robustness, so that the second frame 40 can cause the steering roller 203 to perform the tilting motion (the steering motion), in cooperation with the driving motor 211.

The steering motor 213 is supported in an upper part (in FIG. 11) of the first frame 50; and the driving motor 211 is supported in a lower part (in FIG. 11) of the second frame 40. With this, the intermediate transfer belt unit 100 is configured as an integrally exchangeable unit that does not necessitate mechanical attaching to or detaching from the apparatus body 99*a* (see FIG. 1).

The steering motor 213 causes the second frame 40 to be tilted in the vertical direction as illustrated in FIG. 10, thereby to allow the steering roller 203 to perform the steering control of the intermediate transfer belt 106. The steering motor 213, which is arranged in the beam plate 53 of the first frame 50, causes a beam plate 43 of the second frame 40 to be moved upward and downward by the aid of an eccentric cam 64 fixed on a motor rotational shaft.

Because the steering motor 213, which serves as a driving unit for tilting the second frame 40, is arranged in the first frame 50 as stated above, the following effects or advantages are obtained. Namely, an upper end part of the steering roller 203 (or a part of the steering roller 203 on the rear side), being supported by the second frame 40 in FIG. 11, can be moved with a high degree of accuracy in relation to the first frame 50, which serves as a stationary reference, along the direction perpendicular to the paper of FIG. 11.

A belt edge sensor 62 having the sensor flag 212 (see also FIG. 4) is supported by the beam plate 43 of the second frame 40, and detects a position of the intermediate transfer belt 106 along an axial direction of the steering direction of the steering roller 203 in order to steer the intermediate transfer belt 106 (or in order to perform the belt deviation control for the intermediate transfer belt 106).

The steering control portion 215 drives the steering motor 213 in accordance with an output from the belt edge sensor 62, thereby to rotate the eccentric cam 64. With this, the other end of the second frame 40 (or the upper part of the second frame 40 in FIG. 11) can be raised or lowered. The steering control portion 215 drives the steering motor 213 in accordance with an output from the belt edge sensor 62, and thus causes the tilting motion of the steering roller 203, thereby to perform the belt deviation corrective control by steering the intermediate transfer belt 106.

Figure 12:
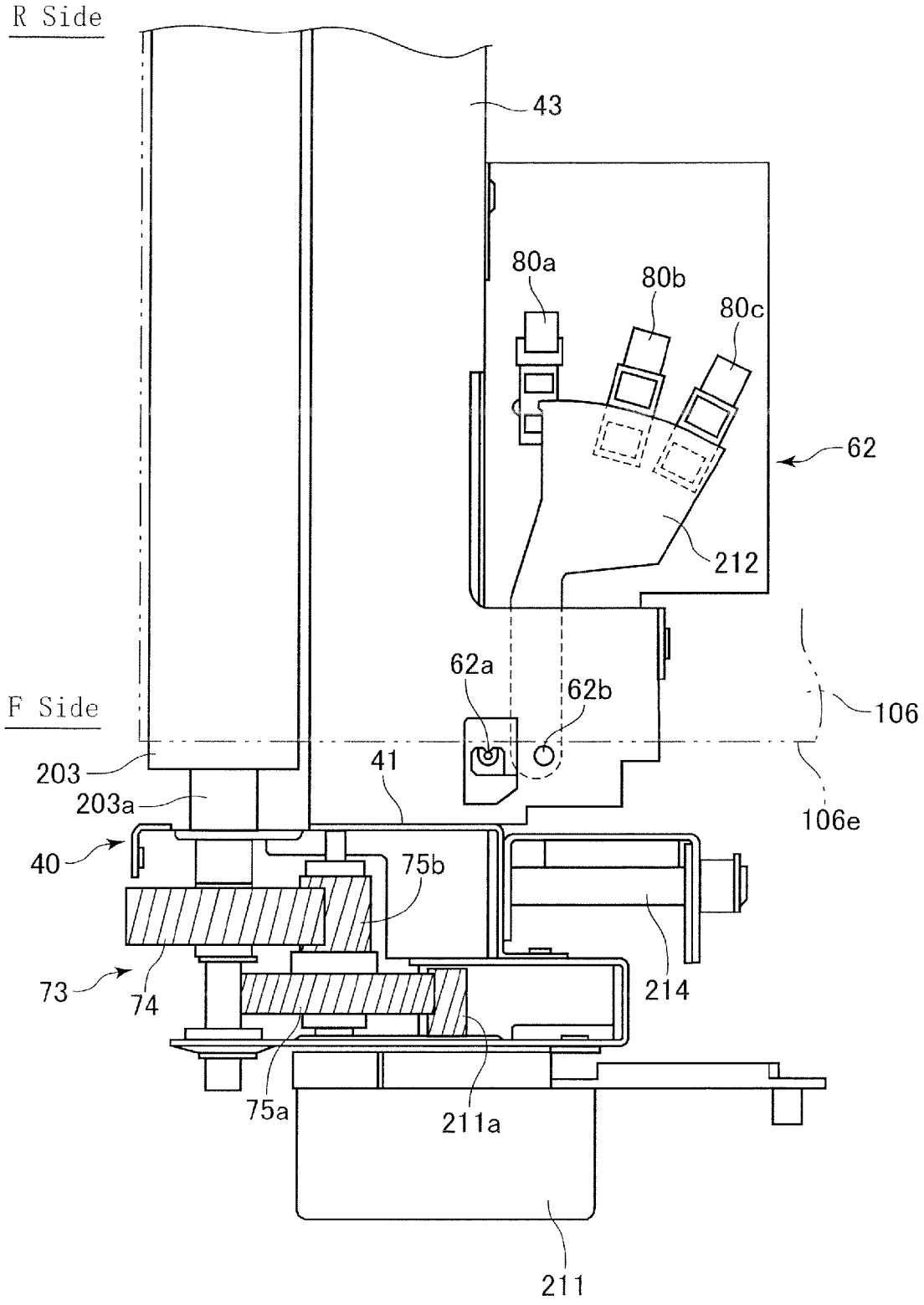
FIG. 12 is an explanatory view explaining a driving mechanism of a driving roller in the fourth embodiment.

Referring to FIG. 11 and FIG. 12, the driving motor 211, which drives the steering roller 203 thereby to rotate the intermediate transfer belt 106, is arranged in a position toward one end side of the second frame 40. The driving motor 211 is configured so as to transmit a driving force from the one end side to the steering roller 203 via a rotational force transmitting mechanism 73. Incidentally, an "F side" in FIG. 11 and FIG. 12 indicates a front side of the intermediate belt unit 100; and an "R side" indicates a rear side of the intermediate belt unit 100.

The rotational force transmitting mechanism 73 is provided with a pinion 211*a* fixed on the rotational shaft of the driving motor 211, a larger diameter gear 75*a* engaged with the pinion 211*a*, a smaller diameter gear 75*b* concentric with the larger diameter gear 75*a*, and a transmission gear 74. The transmission gear 74 is fixed on the rotational shaft 203*a* of the steering roller 203, and engaged with the smaller diameter gear 75*b*.

In addition, the rotational shaft 203*a* is linked with the metal shaft 300 of the steering roller 203 illustrated in FIG. 5A.

Rotation of the driving motor 211 is transmitted to the steering roller 203 through the rotational force transmission mechanism 73, so that the intermediate transfer belt 106 is rotated at a desired speed. A driving variability in association with the tilting motion of the steering roller 203 can be reduced by arranging the driving motor 211 and the rotational force transmission mechanism 73 in the second frame 40 that is also tilted together with the steering roller 203.

The driving motor 211 is arranged on the other side of the steering roller 203 in relation to the pivotal shaft 214 in order to reduce inertia moment around the pivotal shaft 214 serving as a pivot center of the second frame 40 including the steering roller 203 and the driving motor 211. Namely, the pivotal shaft 214 functions as a fulcrum point for the tilting motion of the steering roller 203, and is arranged on the side of the driving motor 211, which is relatively heavy, taking into account a balance at the time of the tilting motion of the steering roller 203. Therefore, even when the steering roller 203 is frequently tilted in a reciprocating manner at a high speed, only a slight impact or vibration caused in the second frame 40 is transmitted to the first frame 50, and speed variability of the intermediate transfer belt 106 due to the impact or vibration can be sufficiently reduced.

As described above, because the second frame 40 including the steering roller 203 and the driving motor 211 has a relatively low inertia moment around the pivotal shaft 214, a smooth steering motion is realized.

Referring to FIG. 12, the belt edge sensor 62 serving as the belt position detecting sensor is configured as a general-purpose photo-sensor that has a plurality of semiconductor sensors of reflection light detection type, thereby to detect a degree of meandering movement of the intermediate transfer belt 106 at real time basis.

The sensor flag 212 that shields a detecting portion of light reception/emission integrated type is supported on the beam plate 43 by the pivotal shaft 62*b*, and pivotable around the pivotal shaft 62*b*. In a base end portion of the sensor flag 212, a detecting roller 62*a* is provided so as to be in contact with an edge portion 106*e* of the intermediate transfer belt 106.

The sensor flag 212 has a light shielding surface at a distal end portion, which is opposite to the base end portion where the detecting roller 62*a* is arranged. Photo-sensors 80*a*, 80*b*, 80*c* are arranged along an edge of the distal end portion of the sensor flag 212, and detect the light shielding surface that can be positioned in different positions in accordance with the pivotal movement of the sensor flag 212.

Here, roller arrangements in the intermediate transfer unit 100 are explained.

Figure 13A:
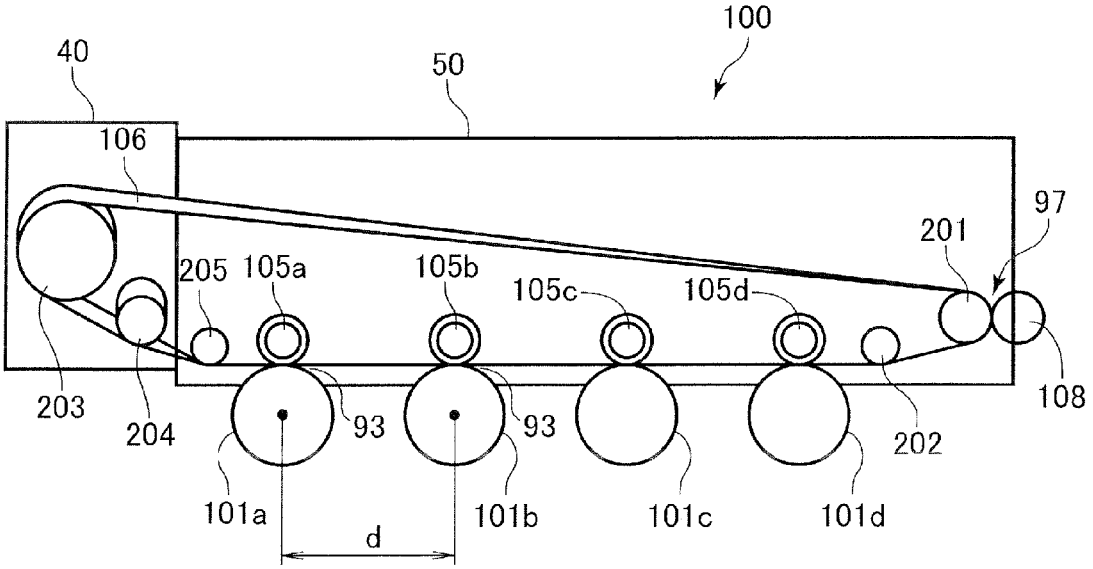
FIG. 13A is a schematic view illustrating an arrangement of rollers of the intermediate transfer belt unit in the fourth embodiment.
Figure 13A:
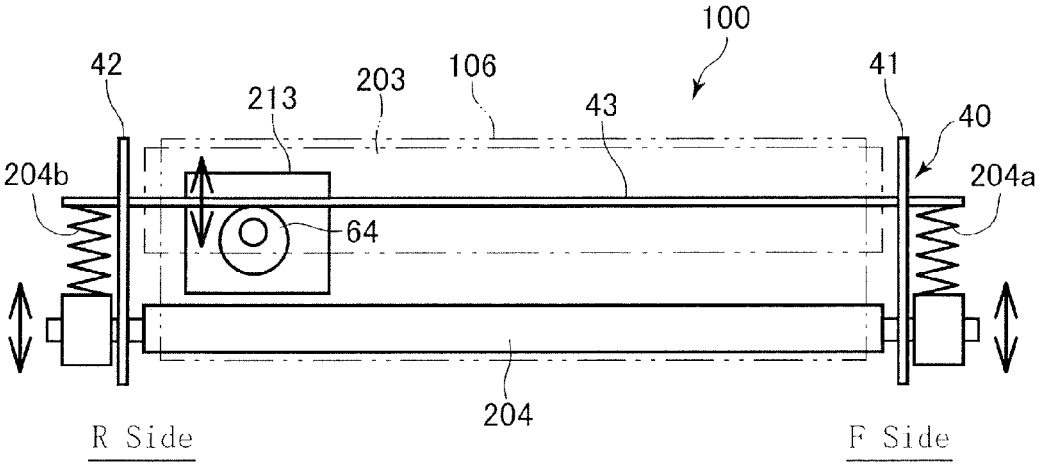

FIG. 13A is a schematic view illustrating roller arrangements in the intermediate transfer belt unit 100; and FIG. 13B is an explanatory view illustrating a supporting mechanism that supports the tension roller 204.

Incidentally, FIG. 13A illustrates the roller arrangements seen from the bottom in FIG. 11; and FIG. 13B illustrates the roller arrangement seen from the left side in FIG. 11.

As illustrated in FIGS. 13A and 13B, the supplementary roller 205 is arranged in front of the primary transfer roller 105*a* in this embodiment, in order to prevent tilting of the intermediate transfer belt 106 by the steering roller 203 from propagating to the primary transfer roller 105*a*. In other words, the tilted surface of the intermediate transfer belt 106 is corrected by the supplementary roller 205, so that the surface of the intermediate transfer belt 106 becomes in parallel with axial directions of the primary transfer roller 105*a* and the photoreceptive drum 101*a*.

In addition, because the intermediate transfer belt 106 tends to become loose in a downstream position in relation to the steering roller 203 along the rotational direction of the intermediate transfer belt 106, the tension roller 204 is arranged in the position. The tension roller 204 applies necessary tensional force to the intermediate transfer belt 106, and thus keeps the intermediate transfer belt 106 tight. With this, a primary transfer surface (the outside surface), which comes in contact with the photoreceptive drums 101*a*-101*d*, of the intermediate transfer belt 106 can be strained by desired tensional force. The tension roller 204 is biased by other end portions of compression springs 204*a*, 204*b* that are supported at one end portion on the second frame 40, so that the necessary tensional force can be applied to the intermediate transfer belt 106.

In this embodiment, because the supplementary roller 205 is arranged between the tension roller 204 and the primary transfer roller 105*a*, the intermediate transfer belt 106, which proceeds toward the primary transfer roller 105*a*, is corrected by the supplementary roller 205, thereby to come to be horizontal. With this, even when the tension roller 204 may be tilted by the tilting motion of the steering roller 203 due to the belt deviation control, an adverse effect that may be caused for the primary transfer surface by the tilting motion can be prevented by the supplementary roller 205. The tension roller 204, which is arranged between the steering roller 203 and the supplementary roller 205, can prevent vibrations and tensional force variations caused in the intermediate transfer belt 106 by the tilting motion of the steering roller 203 from propagating in the intermediate transfer belt 106.

As illustrated in FIG. 13A, the inner secondary transfer roller 201, the idler roller 202, the primary transfer rollers 105*a*-105*d*, and the supplementary roller 205 are supported in the first frame 50. The supplementary roller 205 defines the primary transfer surface for the toner images by stretching the intermediate transfer belt 106 between the steering roller 203 and the photoreceptive drum 101*a*. The supplementary roller 205 corrects the tilt of the primary transfer surface of the intermediate transfer belt 106, which is caused by the tilting motion of the steering roller 203, and maintains the primary transfer surface horizontally. The idler roller 202 stretches the intermediate transfer belt 106 between the inner secondary transfer roller 201 and the photoreceptive drum 105*d*, thereby to define the primary transfer surface.

As described above, the tension roller 204 absorbs the vibrations and the supplementary roller 205 adjusts the primary transfer surface, in the steering (tilting) motion that is performed on the intermediate transfer belt 106 by utilizing the steering roller 203. With these, influences can be reduced which may be caused to an image position in the primary transfer surface of the intermediate transfer belt 106 by vibrations and positional deviations.

In addition, each of the primary transfer rollers 105*a*-105*b* is attached so as to be movable upward and downward in relation to the first frame 50, and are biased by springs (not illustrated in FIG. 13A) so as to press the corresponding one of the photoreceptive drums 101*a*-101*d* with a predetermined pressure force. With this, the horizontally maintained surface of the intermediate transfer belt 106 stretched by the idler roller 202 and the supplementary roller 205 whose shaft ends are positioned by the first frame 50 is properly in contact with the photoreceptive drums 101*a*-101*d*.

On the other hand, the steering roller 203 and the tension roller 204 are supported in the second frame 40. The steering roller 203 applies a stretching force on a part of the intermediate transfer belt 106, the part being positioned opposite to the inner secondary transfer roller 201 in relation to the photoreceptive drums 101*a*-101*d*, and rotates the intermediate transfer belt 106.

A pitch d between the adjacent two of the photoreceptive drums 101*a*, 101*b*, 101*c*, 101*d* is equally set to a circumferential length of (or an integer multiple of the circumferential length of) the inner secondary transfer roller 201. The reason for the pitch d being set in such a manner is to make a period of transfer variations due to eccentric errors of the inner secondary transfer roller 201 coincide with a period of interposing errors of the toner images due to the photoreceptive drums 101*a*-101*d*, thereby to minimize an influence to be exerted on the toner image transferred on the recoding material P. In addition, a diameter of the inner secondary roller 201 is set to be smaller than that of a conventional inner roller, in order to properly curvature-separate (or self-strip) thin paper sheets as the recording material.

In addition, the diameter of the inner secondary transfer roller 201 is set to be smaller, from a reason that the diameter is determined in accordance with the pitch d of the photoreceptive drums 101*a*-101*d*.

Therefore, a diameter of the steering roller 203 is set to be considerably larger than the diameter of the inner secondary transfer roller 201. The steering roller 203 having a larger diameter can reduce a frequency of slipping of the intermediate transfer belt 106 to a greater extent, because a winding length of the intermediate transfer belt 106 on the steering roller 203 becomes longer. However, when such slipping scarcely occurs, driven variations of the steering roller 203 and the tilting motion associated with the belt deviation control may tend to influence the rotational speed of the intermediate transfer belt 106.

The steering roller 203 assures a winding angle of 90° or greater in order to drive the intermediate transfer belt 106, thereby to enhance a gripping force and prevent the slipping of the intermediate transfer belt 106. This is because a minute slipping may cause defective images. Incidentally, the winding angle here corresponds to a central angle of a circular arc where the intermediate transfer belt 106 is in contact with the steering roller 203.

The steering roller 203 so configured in the embodiment has a larger winding angle and thus provides a greater gripping force. Therefore, the movement of the intermediate transfer belt 106 along the axial direction thereof is hardly prevented by slipping, thereby to enable a highly responsive belt deviation control in accordance with a tilting angle of the steering roller 203. However, when the steering roller 203 against which the intermediate transfer belt 106 hardly slips is tilted, tensional force variations tend to occur in a part of the intermediate transfer belt 106, the part being between the idler roller 202 and the supplementary roller 205. Therefore, the tension roller 204 is arranged between the steering roller 203 and the supplementary roller 205 as described above, thereby to reduce the tensional force variations associated with the tilting motion of the steering roller 203.

The tension roller 204 applies a tensional force to the intermediate transfer belt 106 by outwardly pressing the intermediate transfer belt 106 in a part thereof between the steering roller 203 and the supplementary roller 205. With this, a tensional force of, for example, 3 kgf (approximately 29.419 N) is applied to the intermediate transfer belt 106 by the tension roller 204.

Figure 14A:
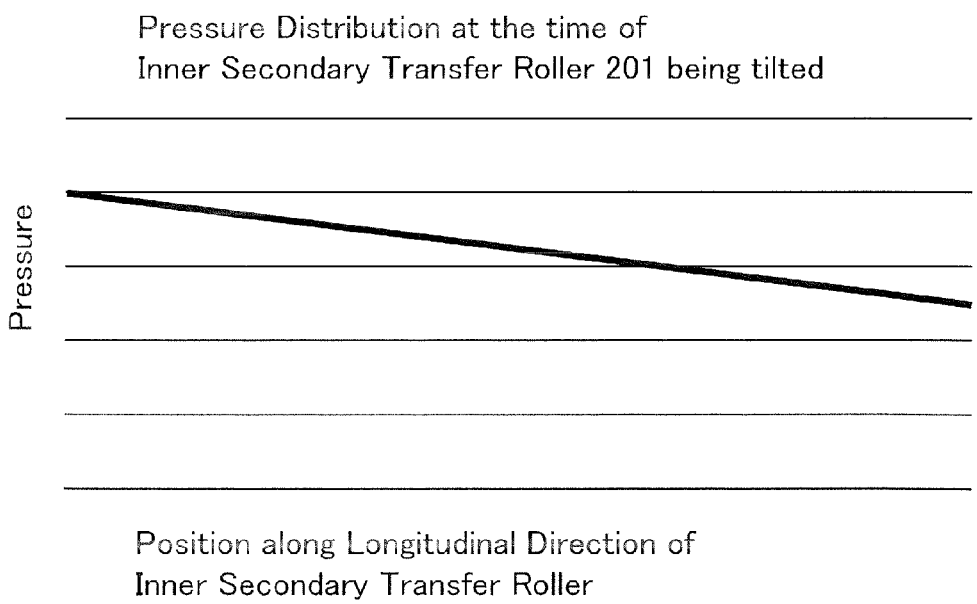
FIG. 14A is an explanatory view explaining a pressure applied to a secondary transfer stretching roller in the fourth embodiment.

When the steering roller 203 drives the intermediate transfer belt 106 when the intermediate transfer belt 106 is tilted with respect to the other stretching rollers, a pressure applied by the intermediate transfer belt 106 to the inner secondary transfer roller 201 arranged upstream in relation to the steering roller 203 is distributed as illustrated in FIG. 14A.

Figure 14B:
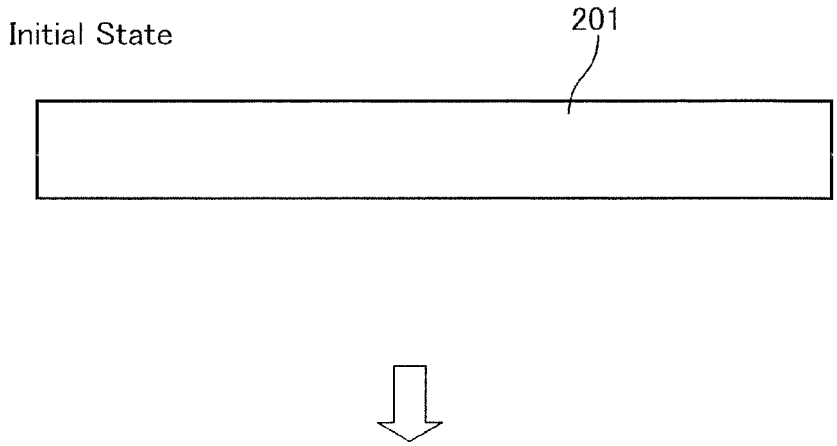
FIGS. 14B and 14C are explanatory views explaining deformation of the secondary transfer stretching roller after prolonged use.
Figure 14C:
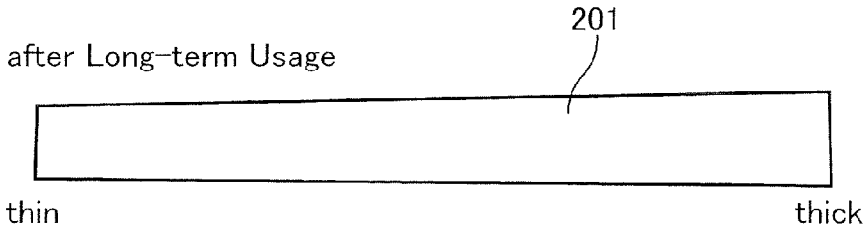

When the inner secondary transfer roller 201 is rotated for a long time in a state where the pressure distribution of the inner secondary transfer roller 201 along the axial (longitudinal) direction thereof is uneven, an outer diameter of the inner secondary transfer roller 201 may vary along the axial direction, as illustrated in FIGS. 14B, 14C, for example. When the inner secondary transfer roller 201 is deformed in such a manner, a belt deviation force is caused which makes the intermediate transfer belt 106 deviated along the longitudinal direction. In addition, the belt deviation force is enhanced because the outer secondary transfer roller 108 presses the inner secondary transfer roller 201.

Figure 15:
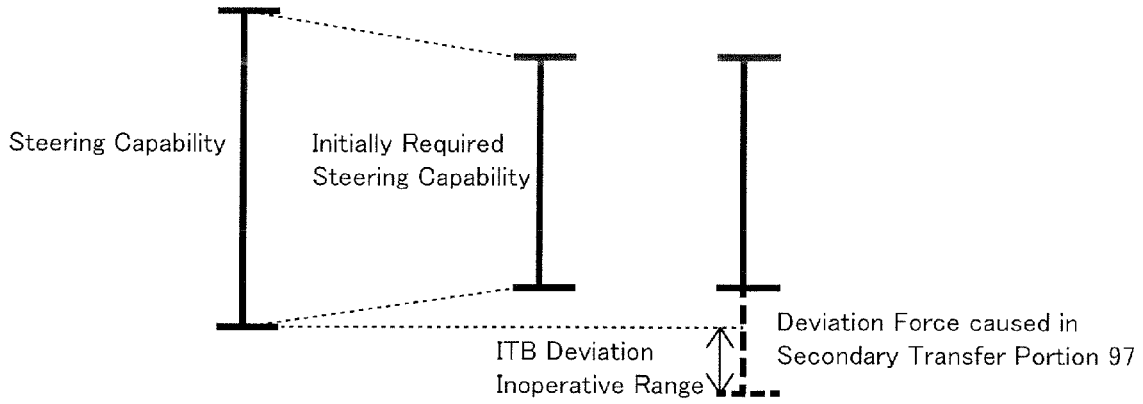
FIG. 15 is an explanatory view explaining a steering capability in the fourth embodiment.

FIG. 15 is an explanatory view illustrating a relationship between the steering capability and the belt deviation force caused in the inner secondary transfer roller 201. As illustrated in FIG. 15, when a steering force beyond the steering capability of the steering roller 203 is caused in the secondary transfer portion 97, it becomes difficult to bring the intermediate transfer belt 106 back to a center position, and the intermediate transfer belt 106 may be fully deviated.

Such difficulties may be solved by further ruining the alignment (or further tilting the steering roller 203), thereby to enhance the steering capability. However, when the movable range (the tilting range) of the steering roller 203 becomes greater, the pressure applied to the inner secondary transfer roller 201 becomes different to a greater degree along the longitudinal direction. As a result, the inner secondary transfer roller 201 is greatly deformed, which may lead to defective images in the secondary transfer portion 97. Therefore, the movable range of the steering roller 203 is preferably narrower.

Figure 16A:
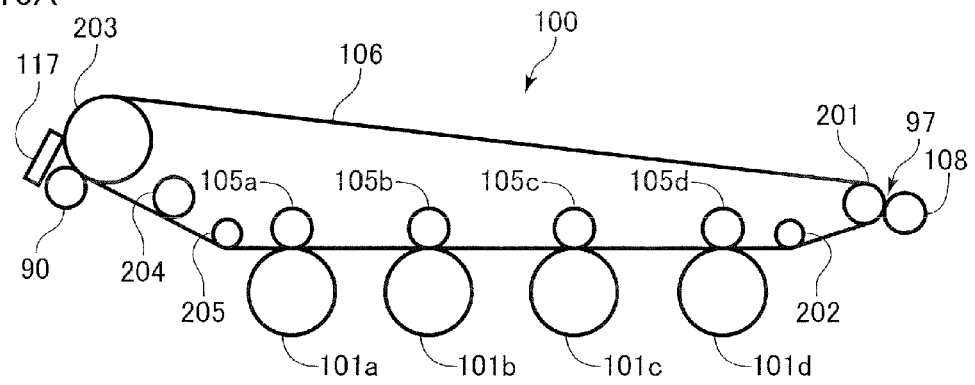
FIG. 16A is a schematic view illustrating an arrangement of rollers in the intermediate transfer belt unit in the fourth embodiment.

In this embodiment, while the movable range of the steering roller 203 is made narrower, the steering roller 203 is allowed to be in contact with the steering supplementary roller 90 arranged downstream in relation to the cleaning blade 117 as illustrated in FIG. 16A, in order to enhance the steering capability. An outer circumference of the steering supplementary roller 90 is made of rubber material. And the steering supplementary roller 90 is as long as or shorter than the steering roller 203 along the axial direction (the longitudinal direction).

The steering supplementary roller 90 is rotatably supported at both end portions thereof along the axial direction. The steering supplementary roller 90 presses the both ends of the steering roller 203 with a predetermined pressure by the aid of a pair of compression springs 89 (see FIG. 17) that serve as biasing members, thereby to create a nip portion together with the steering roller 203. The steering supplementary roller 90 is in contact with a part of the intermediate transfer belt 106, the part being wound around the steering roller 203, and is driven to rotate.

The steering supplementary roller 90 composes a pressure applying rotational body that is biased to apply an external pressure to the steering roller 203 through the intermediate transfer belt 106.

A pressure applied to the steering roller 203 by the compression springs 89 is determined in accordance with a relationship between the belt deviation force caused in the secondary transfer portion 97 and the steering capability. In this embodiment, a pressure of the steering supplementary roller 90 is set to be, for example, 5 kgf (approximately 49.032 N)

under conditions where a pressure of the inner secondary transfer roller 201 is, for example, 6 kfg (approximately 58.839N) and a pressure of the cleaning blade 117 is, for example, 1 kgf (approximately 9.806 N). Incidentally, these pressures depend on various conditions such as the pressures applied, the winding angle of the intermediate transfer belt 106 with respect to the rollers, and diameters of the rollers, and thus are not limited to the above values.

Figure 16B:
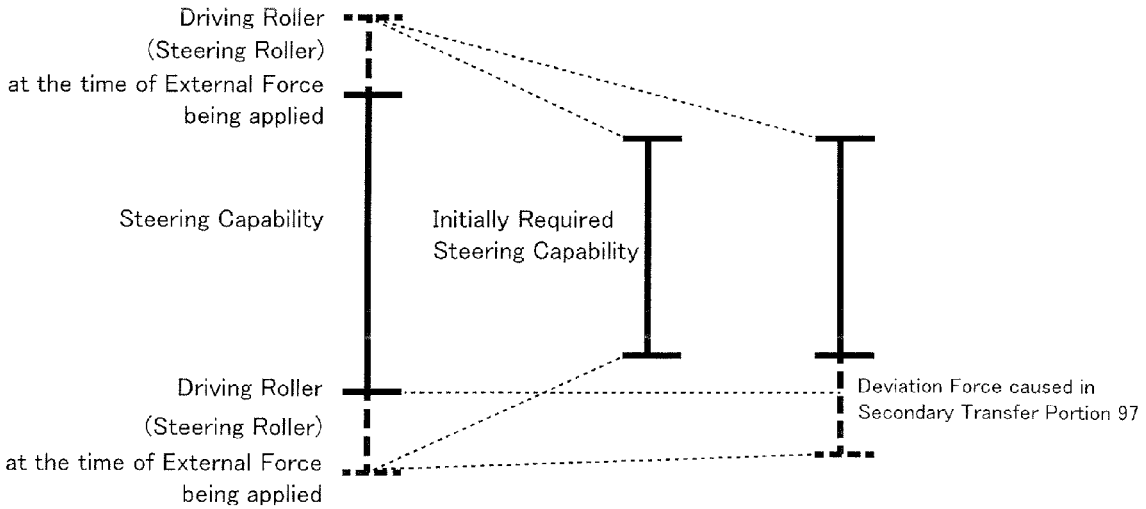
FIG. 16B is an explanatory view explaining the steering capability in the fourth embodiment.

As described above, by arranging the steering supplementary roller 90 in this embodiment, the intermediate transfer belt 106 can be stably driven even when the inner secondary transfer roller 201 is deformed, because the relationship regarding the steering capability as illustrated in FIG. 16B is obtained. Namely, although the steering capability can be illustrated by a solid line in the left hand side of FIG. 16B when the steering supplementary roller 90 is not arranged, the steering capability can be enhanced as illustrated by broken lines when the steering supplementary roller 90 is arranged. With this, even when the deviation force caused in the secondary transfer portion 97 is increased as illustrated by a broken line in the right hand side of FIG. 16B, the deviation force can be managed within the steering capability increased by arranging the steering supplementary roller 90.

Moreover, because the pressure by the steering supplementary roller 90 is changeable in accordance with the number of times of image forming (or a degree of wearing) in the inner secondary transfer roller 201, a PV value regarding the rotational shaft 203*a* (see FIG. 12) of the steering roller 203 can also be reduced. Incidentally, the PV value is a value that gives an operational limit of a bearing, which is obtained by multiplying a bearing pressure and a slipping velocity.

Figure 16C:
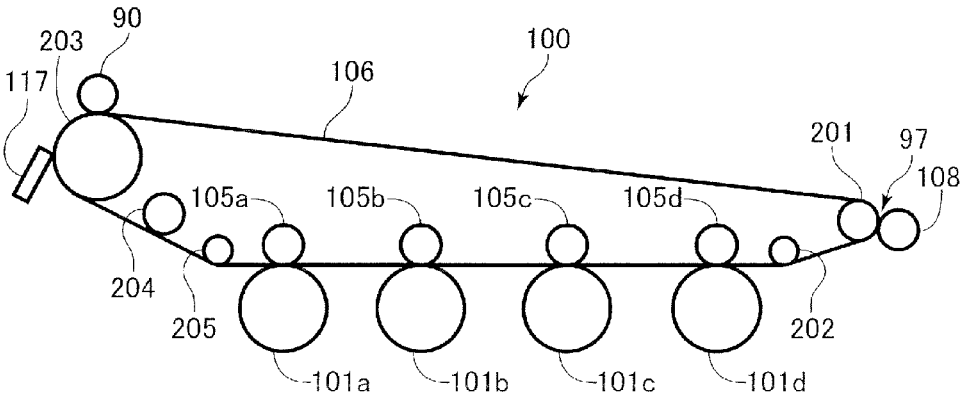
FIG. 16C is a schematic view illustrating an arrangement of rollers in the intermediate transfer belt unit in the fourth embodiment.

The steering supplementary roller 90 serving as a pressure applying rotational body may be arranged upstream in relation to the cleaning blade 117, as illustrated in FIG. 16C. Namely, this steering supplementary roller 90 is arranged upstream in relation to the cleaning blade (the second load member) 117 along the rotational direction of the intermediate transfer belt 106. In such an arrangement, the steering supplementary roller 90 is biased, at one end portions and the other end portions of the axial direction, by the compression springs (biasing members) 89, thereby to apply a pressure on the steering roller 203. In this case, residual toner, which remains on the intermediate transfer belt 106 after secondary transfer has been performed in the secondary transfer portion 97, may be adhered on the steering supplementary roller 90. Because the adhered toner may be scattered by the rotation of the steering supplementary roller 90, the steering supplementary roller 90 is preferably cleaned.

As a cleaning mechanism for cleaning the steering supplementary roller 90, it may be considered to apply a high positive voltage on the steering supplementary roller 90, because the residual tonners are positively charged when a high positive transfer voltage is applied to the secondary transfer portion 97. With this, an amount of the toners to be adhered on the steering supplementary roller 90 can be minimized.

Figure 17:
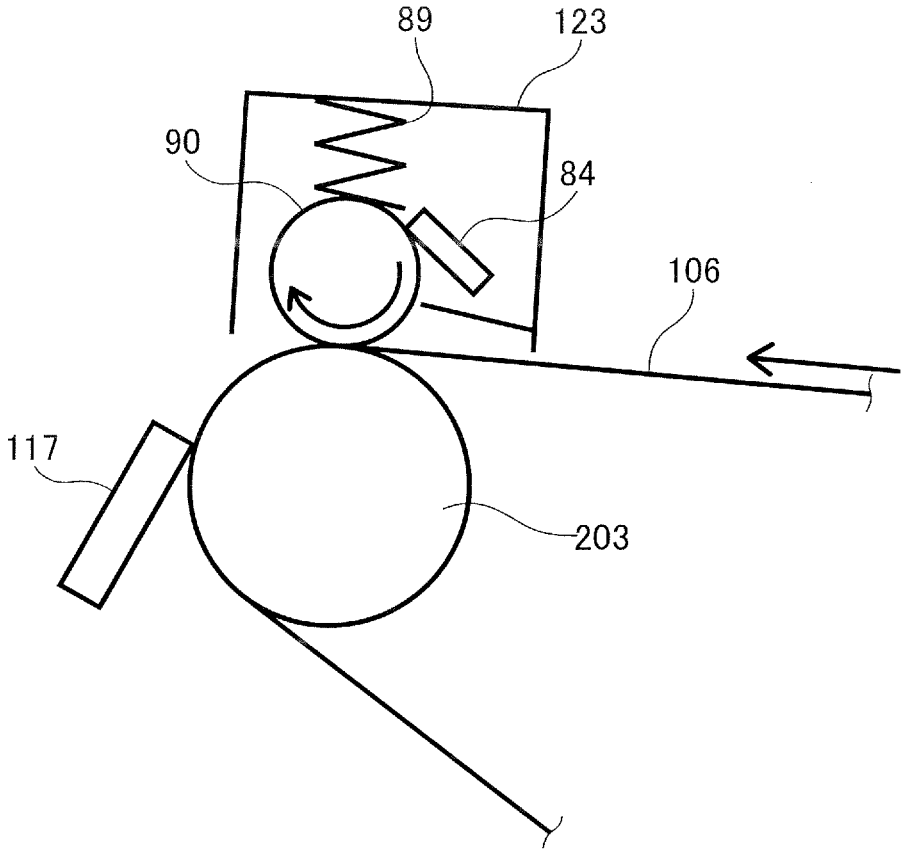
FIG. 17 is a schematic view illustrating an arrangement of a cleaning blade in the fourth embodiment.

In this embodiment, by arranging a cleaning blade 84 serving as the cleaning mechanism for the steering supplementary roller 90 as illustrated in FIG. 17, toners can be effectively prevented from being scattered from the steering supplementary roller 90. Namely, the cleaning blade 84 serving as a cleaning member is arranged so as to be in contact with the steering supplementary roller 90 thereby to clean the steering supplementary roller 90.

In this configuration, the steering supplementary roller 90 is arranged above the steering roller 203 so as to be in contact with the intermediate transfer belt 106, and a casing member 123 is arranged so as to surround the steering supplementary roller 90. In addition, the compression springs 89 serving as biasing members that apply a pressure to the steering supplementary roller 90 are arranged respectively on both end portions along the axial direction of the steering supplementary roller 90, and between an inner upper surface (or a ceiling surface) of the casing member 123 and the steering supplementary roller 90.

The compression springs 89 are in contact with the inner upper surface of the casing member 123. In addition, lower end portions of the compression springs 89 are in contact with supporting portions (not illustrated) that support the steering supplementary roller 90. Moreover, the cleaning blade 84 is arranged in the casing member 123 so that one end portion thereof is in contact with the steering supplementary roller 90 in an upstream position along the rotational direction of the intermediate transfer belt 106.

Furthermore, when the cleaning blade 84 is arranged upstream in relation to the cleaning blade 117, by keeping the compression springs 89 that apply pressures to the respective end portions arranged in such a manner that bottom surfaces thereof can be unchanged even when the steering roller 203 performs the steering motion (or tilting motion), an amount of steering can be reduced.

Figure 18:
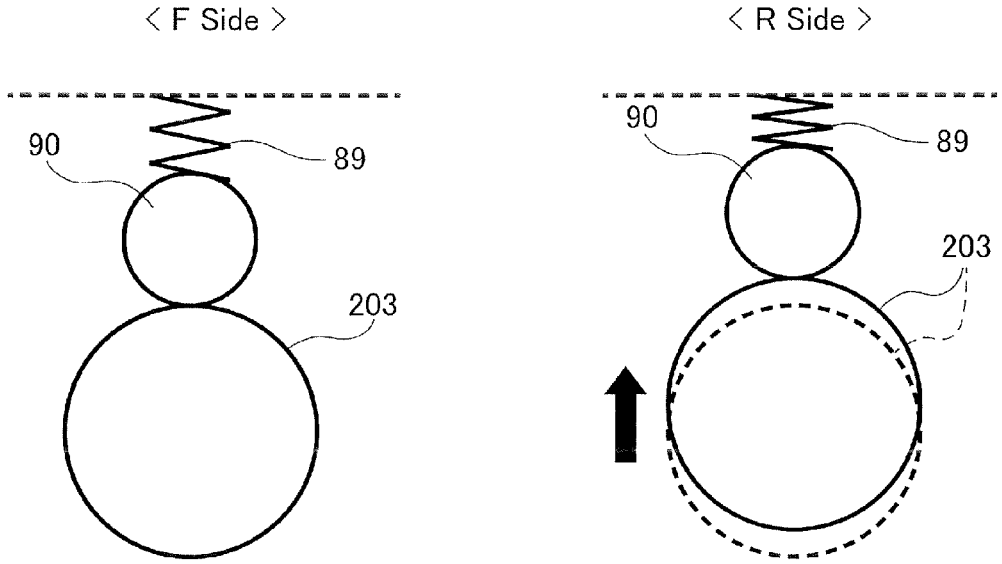
FIG. 18 is an explanatory view explaining an arrangement of the rollers at the time of steering in the fourth embodiment.

Specifically, when a rear side portion (see FIG. 11, or the lower side in a direction perpendicular to the paper of FIG. 16C) of the steering roller 203 is moved (or steered) upward, a deviation force is caused so as to move the intermediate transfer belt 106 toward the rear side. In this case, because the compression spring 89 on the rear side is compressed as illustrated in FIG. 18, a pressure of the steering supplementary roller 90 becomes greater on the rear side, so that the deviation force is caused so as to move the intermediate transfer belt 106 toward the rear side.

Namely, a relatively greater deviation force for moving the intermediate transfer belt 106 toward the rear side can be produced by only slightly steering (or tilting) the steering roller 203. This is because a resultant force of a deviation force caused by the steering (tilting) motion of the steering roller 203 and an additional force caused from a pressure difference between the both ends portions along the axial direction of the steering supplementary roller 90 are applied to the intermediate transfer belt 106.

On the other hand, when the rear side portion of the steering roller 203 is moved (or steered) downward, the pressure acted between the steering roller 203 and the steering supplementary roller 90 becomes lower on the rear side. Therefore, the deviation force that forces the intermediate transfer belt 106 to move toward the front side is caused as a resultant force of forces caused by the steering (tilting) motion and caused from the pressure difference along the axial direction of the steering supplementary roller 90. As the result, a relatively greater deviation force for moving the intermediate transfer belt 106 toward the front side can be produced by only slightly steering (or tilting) the steering roller 203.

As described in this embodiment, the steering roller 203, which is one of a plurality of rollers, is configured to be tiltable in accordance with a position of the intermediate transfer belt 106 along the axial direction thereof.

In addition, the outer secondary transfer roller 108 (see FIG. 2), which serves as the first load member, and the cleaning blade 117, which serves as the second load member, are provided in the intermediate transfer belt unit 100. The aforementioned external force $f_1$ is applied to the inner secondary transfer roller 201 from the outer secondary transfer roller 108 via the intermediate transfer belt 106. In addition, the aforementioned external force $f_2$ is applied to the steering roller 203 from the steering supplementary roller 90 and the cleaning blade 117 via the intermediate transfer belt 106.

With these, in the configurations where the belt deviation control is performed for the intermediate transfer belt 106, the external forces $f_d$, $f_1$ applied to the steering roller 203 via the intermediate transfer belt 106 can be enhanced. Therefore, by allowing the steering supplementary roller 90 to be substantially in contact with the steering roller 203 from outside, the following effects or advantages are obtained in addition to those obtained in the first embodiment. Namely, even when the inner secondary transfer roller 201 is deformed after images are repetitively created, the intermediate transfer belt 106 can be assuredly be stably driven.

The configurations of the fourth embodiment described above are applicable to the first through the third embodiments.

Incidentally, although the steering roller 203 is explained as the driving roller in the fourth embodiment, the present disclosure is not limited to this. For example, the inner secondary roller 201 may function as the driving roller. Namely, the steering supplementary roller 90 is made in contact with the steering roller 203 in order to assure a sufficient steering capability even when the deviation force applied to the intermediate transfer belt 106 in the secondary transfer portion 97 is taken into consideration, in the fourth embodiment. In order to reduce the deviation force caused in the secondary transfer portion 97, it may be considered to reduce the dynamic friction coefficient $\mu$ between the inner secondary transfer roller 201 and the intermediate transfer belt 106. However, the use of the inner secondary transfer roller 201 as the driving roller may lead to slipping of the intermediate transfer belt 106. Therefore, it is difficult to take such a measure as reducing the dynamic friction coefficient $\mu$ of the inner secondary transfer roller 201.

Accordingly, when the inner secondary transfer roller 201 is used as the driving roller, it is very effective measures to make the steering supplementary roller 90 be in contact with the steering roller 203 that is a driven roller in this case, from a viewpoint of stable driving of the intermediate transfer belt 106.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-099322, filed on May 9, 2013 which is hereby incorporated by reference herein in its entirety.

What is claimed is:

1. A belt driving apparatus comprising:

an endless belt;

a steering roller and a supporting roller that support the endless belt rotatably along a circumferential direction of the endless belt;

a tension roller that applies a tensional force on the endless belt supported by the supporting roller and the steering roller;

a first load member that applies a first external force on the supporting roller through the endless belt;

a second load member that applies a second external force on the steering roller through the endless belt;

a controlling portion that changes alignment of the steering roller in relation to the supporting roller thereby to control a position of the endless belt along a width direction perpendicular to the circumferential direction, wherein a relationship $\mu_1(2T\sin(\theta_1/2)+f_1)<\mu_2(2T\sin(\theta_2/2)+f_2)$ is satisfied, where, the $\mu_1$ is a dynamic friction coefficient between the supporting roller and the endless belt, the $\mu_2$ is a dynamic friction coefficient between the steering roller and the endless belt, the $\theta_1$ is a winding angle of the endless belt with respect to the supporting roller, the $\theta_2$ is a winding angle of the endless belt with respect to the steering roller, $f_1$ being the first external force applied to the supporting roller through the endless belt, the $f_2$ is the second external force applied to the steering roller through the endless belt, and the T is a tension force applied to the endless belt by the tension roller.

2. The belt driving apparatus according to claim 1, wherein a surface of the supporting roller provides the dynamic friction coefficient $\mu_1$ that is smaller than the dynamic friction coefficient $\mu_2$.

3. The belt driving apparatus according to claim 2, wherein each of the supporting roller and the steering roller includes a metal shaft provided in the center, and a rubber layer provided on an outer circumference of the metal shaft, and wherein the supporting roller further includes a coating layer provided on a surface of the rubber layer.

4. The belt driving apparatus according to claim 3, wherein the coating layer contains one of silicone and fluorine.

5. The belt driving apparatus according to claim 2, wherein each of the supporting roller and the steering roller includes a metal shaft provided in the center, and a rubber layer provided on an outer circumference of the metal shaft, and wherein the supporting roller further includes a tube formed of a material containing fluorine on a surface of the rubber layer.

6. The belt driving apparatus according to claim 2, wherein each of the supporting roller and the steering roller includes a metal shaft provided in the center, and a rubber layer provided on an outer circumference of the metal shaft, and wherein a surface of the rubber layer of the supporting roller is rougher than a surface of the rubber layer of the steering roller.

7. The belt driving apparatus according to claim 6, wherein the rubber layer of the supporting roller is embossed.

8. The belt driving apparatus according to claim 1, wherein the external force $f_1$ is applied to the supporting roller by the first load member through the endless belt, and wherein the external force $f_2$ is applied to the steering roller by the second load member through the endless belt.

9. The belt driving apparatus according to claim 1, further comprising a pressure applying rotational body that is biased so as to apply an external force to the steering roller through the endless belt.

10. The belt driving apparatus according to claim 9, wherein the external force $f_1$ is applied to the supporting roller by the first load member through the endless belt, and wherein the external force $f_2$ is applied to the steering roller by the second load member and the pressure applying rotational body through the endless belt.

11. The belt driving apparatus according to claim 10, wherein the pressure applying rotational body is arranged upstream in relation to the second load member along a rotational direction of the endless belt, and wherein the pressure applying rotational body is biased at one end portion and the other end portion thereof along an axial direction of the pressure applying rotational body by corresponding biasing members, thereby to apply a pressure to the steering roller.

12. The belt driving apparatus according to claim 11, further comprising a cleaning member that is in contact with the pressure applying rotational body, thereby to clean the pressure applying rotational body.

13. An image forming apparatus comprising:

the belt driving apparatus according to claim 1; and an image forming portion that forms an image on the endless belt that serves as an intermediate transfer belt to be transported.

* * * * *